US006469477B2

(12) United States Patent
Sugimura

(10) Patent No.: US 6,469,477 B2
(45) Date of Patent: Oct. 22, 2002

(54) POWER-ON RESET CIRCUIT

(75) Inventor: Naoaki Sugimura, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 10/038,912

(22) Filed: Jan. 8, 2002

(65) Prior Publication Data

US 2002/0101223 A1 Aug. 1, 2002

(30) Foreign Application Priority Data

Jan. 30, 2001 (JP) ..... 2001-021265

(51) Int. Cl.[7] ..... G05F 1/40
(52) U.S. Cl. ..... 323/265
(58) Field of Search ..... 363/49; 323/265, 323/349

(56) References Cited

U.S. PATENT DOCUMENTS 5,610,550 A * 3/1997 Furutani ..... 327/543
5,866,957 A * 2/1999 Baba et al. ..... 307/113
5,930,129 A * 7/1999 Sugimura ..... 363/49

FOREIGN PATENT DOCUMENTS

JP 63-246919 10/1988
JP 04-072912 3/1992
JP 06-196989 7/1994

* cited by examiner

*Primary Examiner*—Bao Q. Vu
(74) *Attorney, Agent, or Firm*—Volentine Francos, PLLC

(57) ABSTRACT

This invention provides a power-on reset circuit capable of eliminating a wasteful current consumption after the power-on reset pulse generation even when the electric current flowing path means in the capacitor charge time constant circuit is configured by using a minute MOS element in which the off-leakage current tends to increase. More specifically, the present invention provides a power-on reset circuit comprising a power supply voltage sensing circuit 10, a capacitance element charge time constant circuit 30, an off-leakage current capacitance element charge cutoff circuit 20 and an output circuit 35, and wherein the charge to the MOS capacitance capacitor NMOS 33 by the off-leakage current from PMOS 31, the electric current flowing path means in the capacitance element charge time constant circuit is cut off by NMOS 25, the charge cutoff means in the off-leakage current capacitance element charge cutoff circuit when the power supply voltage is less than a specific threshold voltage, and the charge to the MOS capacitance capacitor in the capacitance element charge time constant circuit starts when the power supply voltage becomes more than a specific threshold voltage.

16 Claims, 27 Drawing Sheets

POWER-ON RESET CIRCUIT

BACKGROUND OF THE INVENTION

1. Field of the Invention

The present invention relates to a power-on reset circuit set in a semiconductor integrated circuit and generating a one-shot power-on reset pulse (one-shot pulse) in the power application to reset other circuits in the semiconductor integrated circuit.

2. Related Art

A conventional power-on reset circuit has a capacitor charge time constant circuit configured by a charge capacitor, and resistance or current generator, and generates a one-shot pulse in the power application. However, there is a problem in the power-on reset circuit having only the capacitor charge time constant circuit that the one-shot pulse is not generated when the ramp-up speed of a power supply voltage is slower than that of capacitor charge time constant. There are descriptions of arts. coping with this problem such as the ones disclosed in the following documents.

Document 1: JP, 63-246919, A

Document 2: JP, 4-72912, A

Document 3: JP, 6-196989, A

Document 4: U.S. Pat. No. 5,930,129

The power-on reset circuit disclosed in the document 1 comprises a flip-flop set in response to a power supply voltage application and a power supply voltage detection circuit resetting the flip-flop forcibly after a prescribed delay from the time of the power supply voltage rising over a prescribed potential.

The power-on reset circuit disclosed in the document 2 comprises a power supply voltage detection circuit detecting the rise of power supply voltage to a prescribed voltage, a delay circuit delaying the output signal of the power supply voltage detection circuit and a waveform shaping circuit achieving a waveform shaping of the output signal of the delay circuit.

The power-on reset circuit disclosed in the document 3 comprises a voltage control means outputting the output voltage, at which the power supply voltage is set, in the output voltage less than a predetermined voltage and a pulse output circuit outputting a prescribed pulse in response to the difference between the input voltage of the voltage control means and a predetermined voltage reaching a prescribed value after inputting the output voltage of the voltage control means.

The power-on reset circuit disclosed in the document 4 comprises: a voltage sensing means; an electric current path disconnecting means; a capacitor charge time constant circuit having a power supply voltage sensing circuit sensing the power supply voltage application when the electric current disconnecting means is turned on, an electric current flowing path means flowing path based on the sensed voltage, a capacitor charging based on the time constant through the electric current flowing path means, and a discharging means; and an output circuit.

However, when the conventional power-on reset circuit is configured by using a minute MOS element in which the off-leakage current through the MOS (under high temperature) tends to increase with recent development of process-minuteness of the semiconductor integrated circuit, there are following problems therein. FIGS. 24–27 are circuit diagrams showing examples of the conventional power-on reset circuit, and are respectively shown in the documents 1–4.

The power-on reset circuit disclosed in the document 1 comprises a flip-flop 2 configured by two inverters 2*a* and 2*b* and detecting and keeping the rise of power supply voltage, a capacitor 3 connected to the flip-flop 2, a MOS transistor 4 and a power supply voltage circuit 10. The power supply voltage circuit 10 has two steps of inverters 11 and 12, a MOS diode array 14 configured by plural MOS diodes 13, a capacitor 15 and a MOS transistor 16, the connection of which is shown in FIG. 24.

As described above, the power-on reset circuit disclosed in the document 1 has the configuration that a reset signal for the flip-flop 2 is forcibly generated by establishing a supportive circuit in parallel to a general power-on reset circuit comprising a capacitor, a resistance (MOS diode array) and an inverter. When the off-leakage current is sent on the MOS diode array in the circuit configuration, the charge of the capacitor 15 is started by the off-leakage current through the MOS diode array and a forcible reset signal for the flip-flop 2 is generated at the moment of the power application, at the ramp-up period of the power supply voltage in the power application, before the power supply voltage reaches the threshold voltage at the MOS diode array. As a result, a one-shot pulse (power-on reset signal) cannot be accurately generated.

The power-on reset circuit disclosed in the document 2 is configured by a power supply voltage detection circuit 20, a delay circuit 30 and a waveform shaping circuit 40 as shown in FIG. 25. The power supply voltage detection circuit 20 has a resistance 21 and an N-channel type MOS diode 22 which are connected between a power supply potential Vcc and a ground, and has a resistance 24 one end of which is connected to a connection point N1 of the resistance 21 and the MOS diode 22. An inverter 25 operating with the power supply voltage and the drain of an N-channel type MOS transistor (hereafter, referred to as NMOS) 26 are connected to a connection point N2 of resistances 23 and 24. The inverter 25 is configured by a P-channel type MOS transistor (hereafter, referred to as PMOS) 25*a* and NMOS 25*b*. The gate of the NMOS 26 is connected to the output terminal of the inverter 25 while the source of the NMOS 26 is connected to the ground. The delay circuit 30 has NMOS 31 the source of which is connected to the output terminal of the inverter 25 and the gate of which is connected to the power supply potential Vcc, and has a capacitor 32 connected between the drain of the NMOS 31 and the ground. The waveform shaping circuit 40 has an inverter 41 the input terminal of which is connected to a connection point N3 of the NMOS 31 and the capacitor 32, and has PMOS 42 the gate of which is connected to the output terminal of the inverter 41.

As described above, the power-on reset circuit disclosed in the document 2 has the configuration that the resistances 21, 23 and 24 in the power supply voltage detection circuit 20 divide the voltage between the power supply potential Vcc and the ground. Therefore, there is a problem that since current flows through the resistances 21, 23 and 24, the current consumption cannot reach 0 even after an one-shot pulse is generated.

Further, when the off-leakage current is sent on the PMOS 42 in the waveform shaping circuit 40 the charge of the capacitor 32 is started by the off-leakage current through the PMOS 42 and the PMOS 42 is forced to be turned on by inverting the output of the inverter 41 and NMOS 26 in the power supply voltage detection circuit 20 is also forced to be turned on, at the ramp-up period of the power supply voltage in the power application, before the power supply voltage reaches the prescribed power supply voltage detected at the power supply voltage detection circuit 20. As a result, the one-shot pulse (power-on reset signal) cannot be accurately generated.

The power-on reset circuit disclosed in the document 3 has an enhancement-type PMOS 51 the source of which is connected to a power supply potential Vdd and has a voltage control circuit 52 connected between the drain of the PMOS 51 and the ground thereof, as shown in FIG. 26. The voltage control circuit 52 has a depression-type NMOS 52*a* the drain of which is connected to the source of the PMOS 51, and has an enhancement-type NMOS 52*b* the gate and drain of which are connected to the gate and source of the NMOS 52*a*. The source of the NMOS 52*b* is connected to the ground. The drain of an enhancement-type NMOS 54 and a pulse generation part 53 are connected to the output terminal of the voltage control circuit 52. The source of the enhancement-type NMOS 54 is grounded. The pulse generation part 53 has an enhancement-type PMOS 53*a* the source of which is connected to the power supply potential Vdd, a capacitor 53*b* connected between the PMOS 53*a* and the ground thereof and an inverter 53*c* the input terminal of which is connected to the connection point of the PMOS 53*a* and the capacitor 53*b*. The output side of the inverter 53*c* in the pulse generation part 53 is connected to the output terminal and the inverter 55. The output side of the inverter 55 is connected to the gate of the PMOS 51 and the gate of the NMOS 54.

Further in the power-on reset circuit disclosed in the document 3, when the off-leakage current is sent on the PMOS 53*a* in the pulse generation part 53 the charge of the capacitor 53*b* is started by the off-leakage current through the PMOS 53*a* and the PMOS 51 is forced to be turned off by inverting the outputs of the inverters 53*c* and 55 and PMOS 53*a* in the pulse generation part 53 is forced to be turned on, at the ramp-up period of the power supply voltage in the power application, before the power supply voltage reaches the power supply voltage value at which the voltage control circuit 52 starts outputting the voltage difference from the voltage Vdd at which the PMOS 53*a* in the pulse generation part 53 is turned on. As a result, a one-shot pulse (power-on reset signal) cannot be accurately generated.

The power-on reset circuit disclosed in the document 4 has a power supply voltage sensing circuit 60, a capacitor charge time constant circuit 70 and an output circuit 75, as shown in FIG. 27. The power supply voltage sensing circuit 60 has a first transistor PMOS 61 the source of which is connected to the first power supply potential Vcc and which functions as an electric current path disconnecting means, and has PMOS 62 and PMOS 63 which form a rectifier functioning as a voltage sensing means and which are connected between the drain of the PMOS 61 and a second power supply potential, that is, a ground GND. The voltage difference between a potential Vcc and the ground GND shows the supplied power supply potential Vcc. The source of the PMOS 62 is connected to the drain of the PMOS 61. A first connection node N60 of the drain of the PMOS 61 and the source of the PMOS 62 is the output terminal of the power supply voltage sensing circuit 60. The capacitor charge time constant circuit 70 has a second transistor PMOS 71 the gate of which is connected to a node N60, the source of which is connected to the power supply potential Vcc and which functions as an electric current flowing path means, and has a third transistor PMOS 72 the gate of which is connected to the power supply potential Vcc and which functions as a discharging means. The drain of the PMOS 71 is connected to the source of the PMOS 72 and to one electrode of the capacitor 73. The drain of the PMOS 72 and the other electrode of the capacitor 73 are connected to the ground GND in common. The gate of the PMOS 72 is connected to the power supply potential Vcc. The connection point of the drain of the PMOS 71, the source of the PMOS 72 and the capacitor 73 is a second node N70, which is connected to the gate of the PMOS 61 as the output terminal of the capacitor charge time constant circuit 70 and to the input terminal of the inverter 75. The inverter 75 is driven by the power supply potential Vcc as the power supply voltage sensing circuit 60 and the capacitor charge time constant circuit 70, and an one-shot pulse is output from the output terminal of the inverter 75.

Further in the power-on reset circuit disclosed in the document 4, when the off-leakage current is sent on the PMOS 71 in the capacitor charge time constant circuit 70, the charge of the capacitor 73 is started by the off-leakage current through the PMOS 71, at the ramp-up period of the power supply voltage in the power application, before the power supply voltage reaches the power supply voltage value at which the power supply voltage sensing circuit 60 starts outputting the voltage difference from the voltage Vdd at which the PMOS 71 in the capacitor charge time constant circuit 70 is turned on. As a result, the one-shot pulse (power-on reset signal) cannot be accurately generated.

As described above, the conventional power-on reset circuit, in which the one-shot pulse is generated even when the ramp-up speed of the power supply voltage is slower than the time constant of the capacitor charge, has the circuit configuration that the supply of time constant current-charging to the capacitor is controlled by a MOS active element, and the countermeasure to the MOS element leakage current is not taken. Therefore, when the conventional power-on reset circuit is configured by using a minute MOS element in which the off-leakage current through the MOS (under high temperature) tends to increase with recent development of process-minuteness of the semiconductor integrated circuit, it is difficult to generate the one-shot pulse accurately.

SUMMARY OF THE INVENTION

To achieve the above object, in the first aspect of the present invention, there is provided a power-on reset circuit comprising: a first node to which a power supply voltage is supplied; a second node to which a reference voltage is supplied; a voltage supply circuit which has a first switch electrically connecting the first node with a fourth node in response to a voltage level of a third node, and a diode being connected to the second node and to the fourth node; a time constant circuit which has a second switch electrically connecting the first node with the third node in response to the voltage level of the fourth node, and a capacitor being connected to the second node and to the third node; and a third switch which electrically connects the second node with the third node in response to the voltage level of the fourth node.

In the second aspect of the present invention, there is provided a power-on reset circuit comprising a power supply voltage sensing circuit, a capacitance element charge time constant circuit, an off-leakage current capacitance element charge cutoff circuit and an output circuit. The power supply voltage sensing circuit comprises a voltage sensing means connected between a first power supply potential and a second power potential which show the power supply voltage by the potential difference to flow and form the electric current path when the power supply voltage reaches more than a specific threshold value and showing the sensed voltage on a first node, and an electric current path disconnecting means achieving on-off control based on the feedback voltage to disconnect the electric current path in the off-state. Further, the power supply voltage sensing circuit senses the power supply voltage application with the electric current path disconnecting means on-state.

The capacitance element charge time constant circuit comprises an electric current flowing path means connected between the first power supply potential and the second node and flowing path based on the sensed voltage, a capacitance element connected between the second node and the second power supply potential to charge based on the time constant through the electric current flowing path means, and a discharging means flowing path when the power supply voltage is less than the specific threshold voltage to discharge the capacitance element.

The off-leakage current capacitance element charge cutoff circuit comprises a charge cutoff means cutting off the charge to the capacitance element by the off-leakage current from the electric current flowing path means in the capacitance element charge time constant circuit.

The output circuit, the driving source of which is the power source voltage, judges the second-node voltage by a specific threshold value and outputs an one-shot pulse with logical-level in response to the judging result.

Further, there is provided a power-on reset circuit wherein the second node voltage is applied to the charge cutoff means in the power supply voltage sensing circuit as the feedback voltage, the charge to the capacitance element by the off-leakage current from the electric current flowing path means in the capacitance element charge time constant circuit is cut off by the charge cutoff means in the off-leakage current capacitance element charge cutoff circuit when the power supply voltage is less than the specific threshold voltage, and the charge to the capacitance element in the capacitance element charge time constant circuit starts when the power supply voltage becomes more than the specific threshold voltage.

Further, in the third aspect of the present invention, there is provided a power-on reset circuit comprising a power supply voltage sensing circuit, a capacitance element charge time constant circuit, an off-leakage current capacitance element charge cutoff circuit, an output circuit and an inverter element. The power supply voltage sensing circuit comprises a voltage sensing means connected between a first power supply potential and a second power potential which show the power supply voltage by the potential difference to flow and form the electric current path when the power supply voltage reaches more than a specific threshold value and showing the sensed voltage on a first node, and an electric current path disconnecting means achieving on-off control based on the feedback voltage to disconnect the electric current path in the off-state. Further, the power supply voltage sensing circuit senses the power supply voltage application with the electric current path disconnecting means on-state.

The capacitance element charge time constant circuit comprises an electric current flowing path means connected between the first power supply potential and the second node and flowing path based on the sensed voltage, a capacitance element connected between the second node and the second power supply potential to charge based on the time constant through the electric current flowing path means, a discharging means flowing path when the power supply voltage is less than the specific threshold voltage to discharge the capacitance element.

The off-leakage current capacitance element charge cutoff circuit has a charge cutoff means cutting off the charge to the capacitance element by the off-leakage current from the electric current flowing path means in the capacitance element charge time constant circuit.

The output circuit, the driving source of which is the power source voltage, judges the second-node voltage by a specific threshold value and outputs an one-shot pulse with logical-level in response to the judging result.

The inverter element outputs a one-shot pulse inversion signal to clamp the operation of the power supply voltage sensing circuit after the output of the one-shot pulse from the output circuit.

Further, there is provided a power-on reset circuit wherein the second node voltage is applied to the charge cutoff means as the feedback voltage, the charge to the capacitance element by the off-leakage current from the electric current flowing path means in the capacitance element charge time constant circuit is cut off by the charge cutoff means in the off-leakage current capacitance element charge cutoff circuit when the power supply voltage is less than the specific threshold voltage, and the charge to the capacitance element in the capacitance element charge time constant circuit starts when the power supply voltage becomes more than the specific threshold voltage.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

Figure 1:
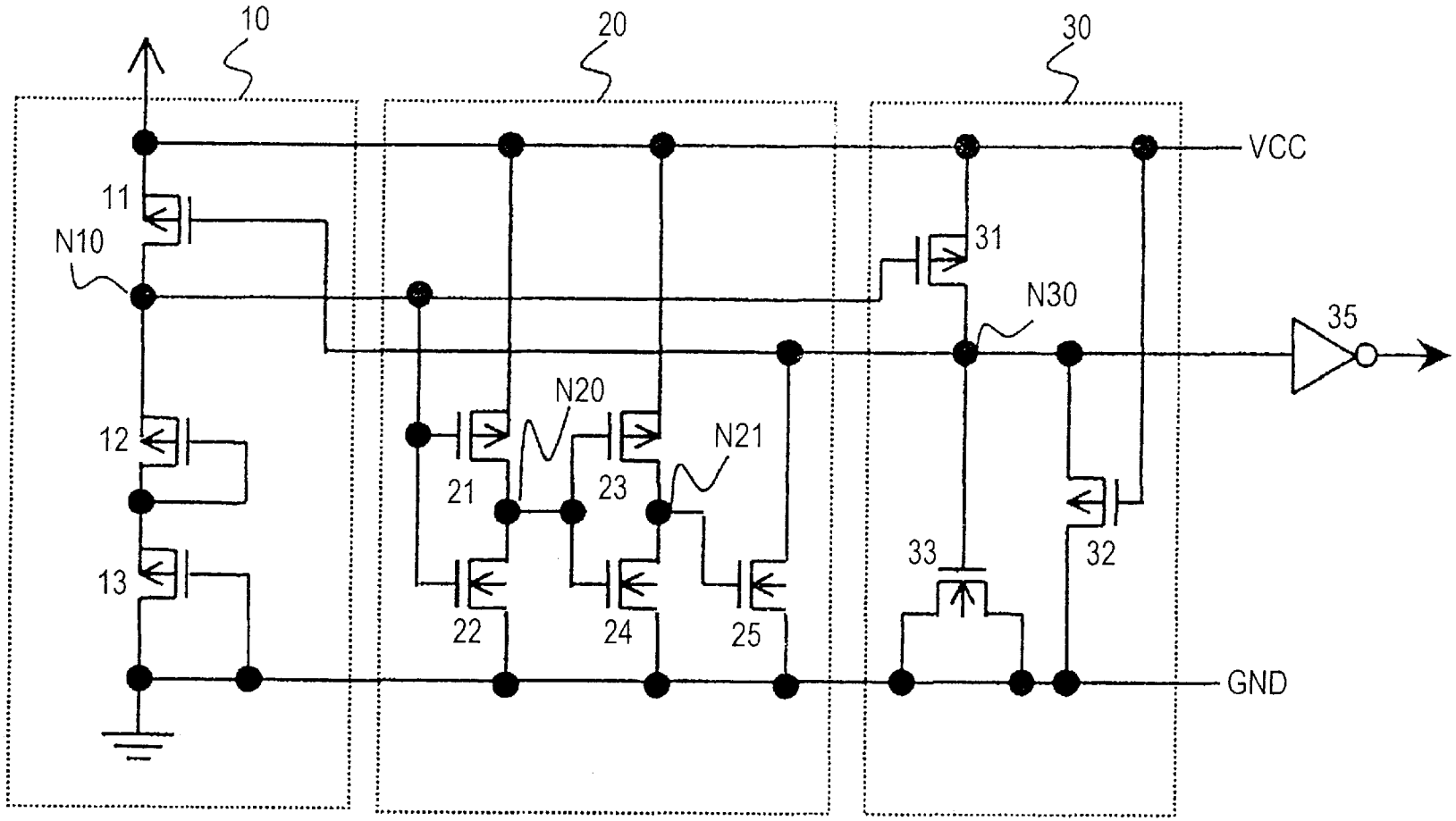
FIG. 1 is an explanatory diagram showing the power-on reset circuit in first embodiment.

Hereinafter, the preferred embodiment of the present invention will be described in reference to the accompanying drawings. Same reference numerals are attached to components having same functions in following description and the accompanying drawings, and a description thereof is omitted.

First Embodiment

FIG. 1 is a circuit diagram of the power-on reset circuit in the first embodiment of the present invention. The power-on reset circuit has a power supply voltage sensing circuit 10, an off-leakage current capacitor charge cutoff circuit 20, a capacitor charge time constant circuit 30 and an output circuit 35.

The power supply voltage sensing circuit 10 has PMOS 11 the source of which is connected to the first power supply potential Vcc and which functions as an electric current path disconnecting means, and has PMOS 12 and PMOS 13 which form a rectifier functioning as a voltage sensing means and which are connected between the drain of the PMOS 11 and a second power supply potential, that is, a ground GND. The voltage difference between the power supply potential Vcc and the ground GND shows the supplied power supply potential Vcc. The source of the PMOS 12 is connected to the drain of the PMOS 11 and to the gate of the PMOS 12. A connection node N10 of the drain of the PMOS 11 and the source of the PMOS 12 is the output terminal of the power supply voltage sensing circuit 10.

The capacitor charge time constant circuit 30 has PMOS 31 the gate of which is connected to a node N10 and the source of which is connected to the power supply potential Vcc and which functions as an electric current flowing path means, and has PMOS 32 the gate of which is connected to the power supply potential Vcc and which functions as a discharging means. The drain of the PMOS 31 is connected to the source of the PMOS 32 and to the gate of the MOS capacitance capacitor NMOS 33. The drain of the PMOS 32 and the source and drain of the NMOS 33 are connected to the ground GND in common. The gate of the PMOS 32 is connected to the power supply potential Vcc. The connection point of the drain of the PMOS 31, the source of the PMOS 32 and the gate of the NMOS 33 is a node N30, which is connected to the gate of the PMOS 31 as the output terminal of the capacitor charge time constant circuit 30 and to the input terminal of the inverter 35.

The off-leakage current capacitor charge cutoff circuit 20 has PMOS 21 the gate of which is connected to a node N10 and the source of which is connected to the power supply potential, NMOS 22 the gate of which is connected to a node N10 and the source of which is connected to the ground GND, PMOS 23, the gate of which is connected to a connection node N20 of the drains of the PMOS 21 and NMOS 22 and the source of which is connected to the power supply potential Vcc, NMOS 24 the gate of which is connected to a node N20 and the source of which is connected to the ground GND, and NMOS 25, the gate of which is connected to a connection node N21 of the drains of the PMOS 23 and NMOS 24, the source of which is connected to the ground GND, the drain of which is connected to the node N30 and which cuts off the charge of MOS capacitance capacitor NMOS 33 by the off-leakage current from the PMOS 32.

The inverter 35 is driven by the power supply potential Vcc as the power supply voltage sensing circuit 10, the off-leakage current capacitor charge cutoff circuit 20 and the capacitor charge time constant circuit 30, and an one-shot pulse is output from the output terminal of the inverter 35.

FIGS. 9(*a*)–(*f*) is a waveform diagram showing the operation of the power-on reset circuit in FIG. 1. The operation thereof will be explained in reference to FIGS. 9(*a*)–(*f*).

When the power supply potential Vcc is 0V, the PMOS 32 becomes in the state of diode connection and the electric charge with which the gate of the MOS capacitance capacitor NMOS 33 is charged is discharged through the PMOS 32. Therefore, the voltage of the node N30 becomes less than the threshold voltage Vt32 of the PMOS 32, and is applied to the gate of the PMOS 11 as the feedback voltage. In this state, when the power supply voltage Vcc rises as in FIG. 9(*a*), the inverter 35 outputs H level, the voltage of which rises as the power supply potential Vcc as shown in FIG. 9(*c*). When the power supply potential Vcc becomes more than the threshold voltage Vt32, the PMOS 32 is turned off, while when the power supply potential Vcc becomes more than the sum of the threshold voltage Vt32 and the threshold voltage Vt11 of the PMOS 11 (Vt32+Vt11), the PMOS 11 becomes in the status which can be turned on. On the other hand, when the sum of the threshold voltages Vt12 and Vt13 of the two PMOS 12 and 13 (Vt12+Vt13) is set higher than the above sum (Vt32+Vt11), the drain voltage of the PMOS 11 remains clamped by a MOS diode voltage (Vt12+Vt13) configured by the threshold voltages Vt12 and Vt13 of the two PMOS 12 and 13 which are connected to the drain hereof in series. In other words, each PMOS 12 and 13 is not turned on, and the voltage of the node N10 becomes the one almost according to the rise of the power supply potential Vcc. This state continues from the power supply voltage Vcc more than (Vt32+Vt11) to more than (Vt12+Vt13). Therefore, the gate potential of the PMOS 31 becomes almost equal to the power supply potential Vcc and the PMOS 31 remains turned off.

Even though an off-leakage current flows through the PMOS 31 with the gate potential almost equal to the power supply potential Vcc and with the PMOS 31 turned off, the voltage of the node N10 becomes the one almost according to the rise of the power supply potential Vcc. As a result, an node N20 in the off-leakage current capacitor charge cutoff circuit 20 maintains L level, and an node N21 outputs H level, rising as the power supply potential Vcc, as shown in FIG. 9(*b*). Consequently, since the NMOS 25 cutting off the charge of MOS capacitance capacitor NMOS 33 by the off-leakage current from the PMOS 32 is turned on, all the off-leakage current from the PMOS 31 flow into the NMOS 25 as shown in FIG. 9(*e*), and the node N30 maintains a low voltage not inverting the H level in the inverter 35 as shown in FIG. 9(*c*) without charging the gate voltage of the MOS capacitance capacitor NMOS 33 with the off-leakage current at the PMOS 31.

When the power supply voltage Vcc rises to become more than the sum voltage (Vt12+Vt13), the two PMOS 12 and 13 are turned on and current flows through the PMOS 11. Hereby since the node N10 is clamped almost at a constant voltage (Vt12+Vt13) as shown in FIG. 9(*a*), voltage (Vcc−(Vt12+Vt13)) is applied between the source and gate of the PMOS 31. Further when the power supply voltage Vcc rises to become more than the sum of the each threshold voltage Vt12 and Vt13, and the threshold voltage Vt31 of the PMOS 31 (Vt12+Vt13+Vt31), the PMOS 31 becomes completely turned on.

On the other hand, since the node N10 is clamped almost at a constant voltage (Vt12+Vt13), the relative value to the power supply voltage Vcc of the node N10 voltage goes down as the power supply voltage Vcc rises. And since the state of NMOS 22 changes from turned-on to turned-off while the PMOS 21 from off to on, the node N20 potential in the off-leakage current capacitor charge cutoff circuit 20 starts rising as the power supply voltage Vcc rises while the node N21 potential starts going down as the power supply voltage Vcc rises as shown in FIG. 13(*b*). As a result, the NMOS 25 starts being turned off, and the amount of current flowing into the NMOS 25 decreases as shown in FIG. 9(*e*), and finally, the NMOS 25 becomes completely turned off with the rise of the power supply voltage Vcc. The current as shown in FIG. 9(*f*) flows through the PMOS 31. When the NMOS 25 is completely turned off while the PMOS 31 is turned on, the node N30 voltage rises at the speed of the time constant decided by the gate capacity of the MOS capacitance capacitor NMOS 33. When the node 30 voltage reaches the threshold value at the inverter 35, the output value of the inverter 35 changes from H level to L level as shown in FIG. 9(*c*). Hereby the output of the one-shot pulse, which is started with the rise of the output value H from the inverter 35 is ended with the changed output value L from the inverter 35. As the charge of the gate capacitance of the MOS capacitance capacitor NMOS 33 progresses and the node N30 voltage further rises, the gate potential of the PMOS 11 rises and the voltage between the gate and source becomes low, and finally, the PMOS 11 is turned off as shown in FIG. 9(*d*). Hereby the node N10 voltage goes down. Along with the node N10 voltage going down, the PMOS 31 remains turned on to maintain the node N30 level at H level.

As described above, the power-on reset circuit in the first embodiment has the power supply voltage sensing means 10 having the PMOS 11–13 connected in series between the power supply potential Vcc and the ground GND; the capacitor charge time constant circuit 30; and the inverter 35. In the power-on reset circuit, when the power supply potential Vcc becomes more than the voltage (Vt12+Vt13+Vt31), the gate of the MOS capacitance capacitor NMOS 33 in the capacitor charge time constant circuit 30 is started to be charged. As a result, even when the ramp-up speed of the power supply voltage Vcc is slow, the one-shot power-on reset pulse starting from "H" right after the power application and ending with "L" can be accurately generated. Also, since the PMOS 11 finally becomes turned off after the pulse generation, wasteful current compensation can be eliminated after that. Further, since the charge into the gate of the MOS capacitance capacitor NMOS 33 by the PMOS 31 leakage-current in the PMOS 31 turned-off by setting the off-leakage current capacitor charge cutoff circuit 20 is cut off, the problem that the one-shot pulse cannot be output, caused by using a minute MOS element in which the off-leakage current through the MOS (under high temperature) tends to increase.

Second Embodiment

Figure 2:
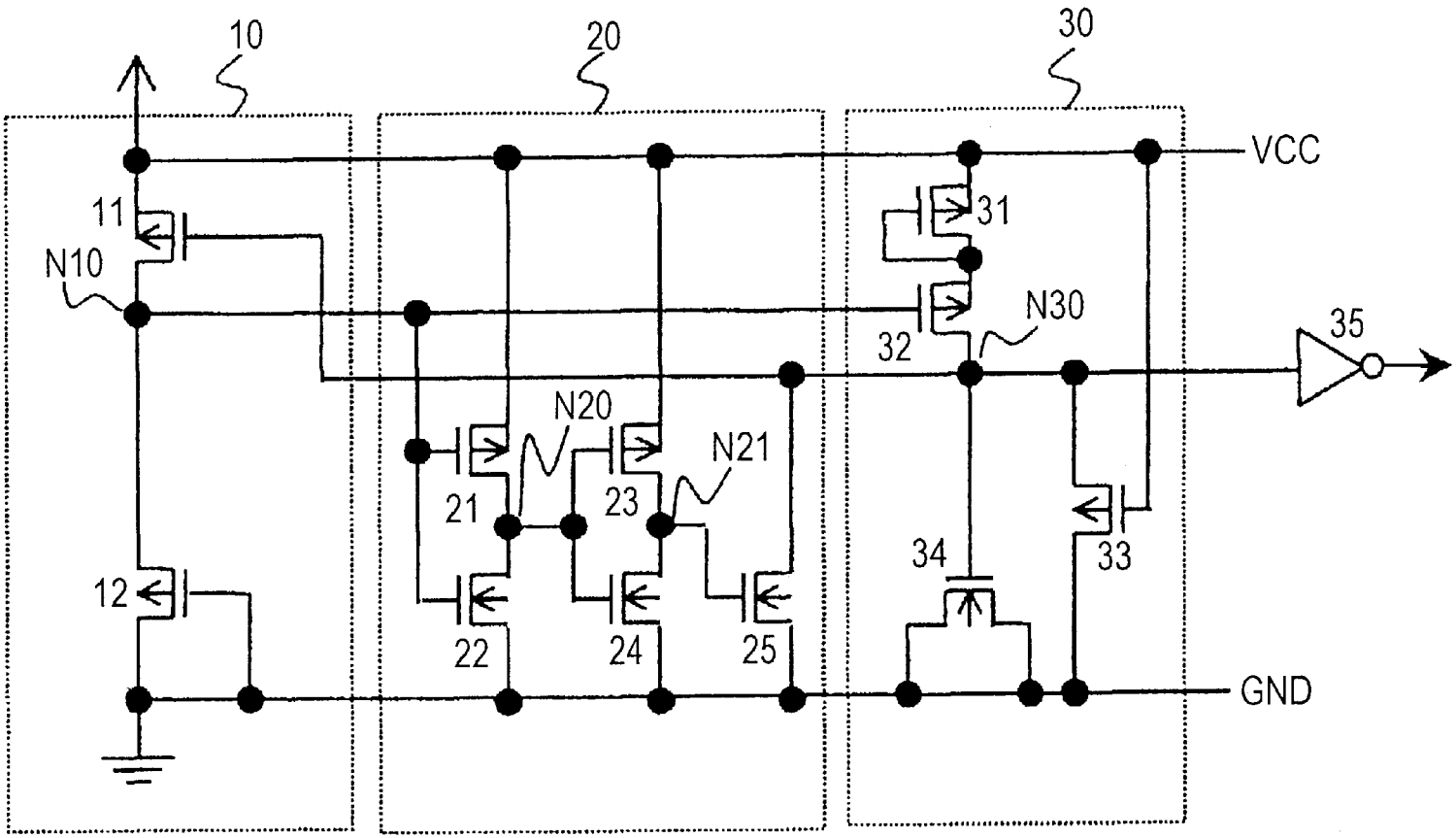
FIG. 2 is an explanatory diagram showing the power-on reset circuit in second embodiment.

FIG. 2 is a circuit diagram of the power-on reset circuit in the second embodiment of the present invention. The power-on reset circuit has a power supply voltage sensing circuit 10 and a capacitor charge time constant circuit 30, which are different in the configuration from those of the first embodiment, an off-leakage current capacitor charge cutoff circuit 20, and an output circuit 35.

The power supply voltage sensing circuit 10 has PMOS 11 the source of which is connected to the power supply potential Vcc and which functions as an electric current path disconnecting means, and has PMOS 12 forming a rectifier and connected between the drain of the PMOS 11 and a ground GND. The source of the PMOS 12 is connected to the drain of the PMOS 11 and the drain and gate of the PMOS 12 is connected to the ground GND. A connection node N10 of the drain of the PMOS 11 and the source of the PMOS 12 is the output terminal of the power supply voltage sensing circuit 10.

The capacitor charge time constant circuit 30 has PMOS 31 the source of which is connected to the power supply potential Vcc and forms rectifier, PMOS 32 the source of which is connected to the drain and gate of the PMOS 31, the gate of which is connected to the node N10, and which functions as an electric current flowing path means, and has PMOS 33 the gate of which is connected to the power supply potential Vcc and which functions as a discharging means. The source of the PMOS 33 is connected to the drain of the PMOS 32 while the drain of the PMOS 33 is connected to the ground GND. A charging MOS capacitance capacitor NMOS 34 is connected between the drain of the PMOS 32 and the ground GND. The connection node N30 of the three points, that is, the drain of the PMOS 32, the source of the PMOS 33 and the gate of a MOS capacitance capacitor NMOS 34, is the output terminal of the capacitor charge time constant circuit 30, and is connected to the gate of the PMOS 11 and to the input terminal of the inverter 35.

The off-leakage current capacitor charge cutoff circuit 20 has PMOS 21 the gate of which is connected to a node N10 and the source of which is connected to the power supply potential, NMOS 22 the gate of which is connected to a node N10 and the source of which is connected to the ground GND, PMOS 23, the gate of which is connected to a connection node N20 of the drains of the PMOS 21 and NMOS 22 and the source of which is connected to the power supply potential Vcc, NMOS 24 the gate of which is connected to a node N20 and the source of which is connected to the ground GND, and NMOS 25, the gate of which is connected to a connection node N21 of the drains of the PMOS 23 and NMOS 24, the source of which is connected to the ground GND, the drain of which is connected to the node N30 and which cuts off the charge of MOS capacitance capacitor NMOS 33 by the off-leakage current from the PMOS 32.

The inverter 35 is driven by the power supply potential Vcc as the power supply voltage sensing circuit 10, the off-leakage current capacitor charge cutoff circuit 20 and the capacitor charge time constant circuit 30, and an one-shot pulse is output from the output terminal of the inverter 35.

FIGS. 10(*a*)–(*f*) is a waveform diagram showing the operation of the power-on reset circuit in FIG. 2. The operation thereof will be explained in reference to FIGS. 10(*a*)–(*f*).

When the power supply potential Vcc is 0V, the PMOS 33 becomes in the state of diode connection and the electric charge with which the gate of the MOS capacitance capacitor NMOS 34 is charged is discharged through the PMOS 33. Therefore, the voltage of the node N30 becomes less than the threshold voltage Vt32 of the PMOS 32, and is applied to the gate of the PMOS 11 as the feedback voltage. In this state, when the power supply voltage Vcc rises as in FIG. 10(*a*), the inverter 35 outputs H level, the voltage of which rises as the power supply potential Vcc as shown in FIG. 10(*c*). When the power supply potential Vcc becomes more than the sum of the threshold voltage Vt33 and the threshold voltage Vt11 of the PMOS 11 (Vt33+Vt11), the PMOS 33 is turned off, while the PMOS 11 becomes in the status which can be turned on. On the other hand, when the threshold voltage Vt12 of the PMOS 12 is set higher than the above sum (Vt33+Vt11), the drain voltage of the PMOS 11 remains clamped by a MOS diode voltage Vt12 configured by the threshold voltage Vt12 of the PMOS 12 connected to the drain hereof in series. In other words, the voltage of the node N10 becomes the one almost according to the rise of the power supply potential Vcc the gate potential of the PMOS 31 becomes almost equal to the power supply potential Vcc and the PMOS 32 remains turned off.

Even though an off-leakage current flows through the PMOS 32 with the gate potential almost equal to the power supply potential Vcc and with the PMOS 32 turned off, the voltage of the node N10 becomes the one almost according to the rise of the power supply potential Vcc. As a result, an node N20 in the off-leakage current capacitor charge cutoff circuit 20 maintains L level, and an node N21 outputs H level, rising as the power supply potential Vcc, as shown in FIG. 10(*b*). Consequently, since the NMOS 25 cutting off the charge of MOS capacitance capacitor NMOS 34 by the off-leakage current from the PMOS 32 is turned on, all the off-leakage current from the PMOS 32 flow into the NMOS 25 as shown in FIG. 10(*e*), and the node N30 maintains a low voltage not inverting the H level in the inverter 35 as shown in FIG. 10(*c*) without charging the gate voltage of the MOS capacitance capacitor NMOS 34 with the off-leakage current at the PMOS 32.

When the power supply voltage Vcc rises to become more than the sum of the threshold voltage Vt12 and the threshold voltage Vt31 of the PMOS 31 (Vt12+Vt31), voltage (Vcc–(Vt12+Vt13)) is applied between the source and gate of the PMOS 32. Further when the power supply voltage Vcc rises to become more than the sum of the each threshold voltage Vt12, Vt31, and the threshold voltage Vt32 of the PMOS 32 (Vt12+Vt31+Vt32), the PMOS 32 becomes completely turned on.

On the other hand, since the relative value to the power supply voltage Vcc of the node N10 voltage goes down as the rise of the power supply potential Vcc, the node N20 potential in the off-leakage current capacitor charge cutoff circuit 20 starts rising as the power supply voltage Vcc rises while the node N21 potential starts going down as the power supply voltage Vcc rises as shown in FIG. 10(*b*). As a result, the NMOS 25 starts being turned off, and the amount of current flowing into the NMOS 25 decreases as shown in FIG. 10(*e*), and finally, the NMOS 25 becomes completely turned off with the rise of the power supply voltage Vcc. When the PMOS 32 is turned on in this state, the current as shown in FIG. 10(*f*) flows through the PMOS 32 and the node N30 voltage rises at the speed of the time constant decided by the gate capacity of the MOS capacitance capacitor NMOS 34. When the node 30 voltage reaches the threshold value at the inverter 35, the output value of the inverter 35 changes from H level to L level as shown in FIG. 10(*c*). Hereby the output of the one-shot pulse, which is started with the rise of the output value H from the inverter 35 is ended with the changed output value L from the inverter 35. As the charge of the gate capacitance of the MOS capacitance capacitor NMOS 34 progresses and the node N30 voltage further rises, the gate potential of the PMOS 11 rises and the voltage between the gate and source becomes low, and finally, the PMOS 11 is turned off as shown in FIG. 10(*d*). Hereby the node N10 voltage goes down. Along with the node N10 voltage going down, the PMOS 32 remains turned on to maintain the node N30 level at H level.

As described above, the power-on reset circuit in the second embodiment has the power supply voltage sensing means 10 having the PMOS 11 and 12 connected in series between the power supply potential Vcc and the ground GND; the capacitor charge time constant circuit 30; and the inverter 35. In the power-on reset circuit, when the power supply potential Vcc becomes more than the voltage (Vt12+Vt31+Vt32), the gate of the MOS capacitance capacitor NMOS 34 in the capacitor charge time constant circuit 30 is started to be charged. As a result, even when the ramp-up speed of the power supply voltage Vcc is slow, the one-shot power-on reset pulse starting from "H" right after the power application and ending with "L" can be accurately generated. Also, since the PMOS 11 finally becomes turned off after the pulse generation, wasteful current compensation can be eliminated after that. Further, since the charge into the gate of the MOS capacitance capacitor NMOS 34 by the PMOS 32 leakage-current in the PMOS 32 turned-off by setting the off-leakage current capacitor charge cutoff circuit 20 is cut off, the problem that the one-shot pulse cannot be output, caused by using a minute MOS element in which the off-leakage current through the MOS (under high temperature) tends to increase.

Further, the power-on reset circuit in the second embodiment is effective to generate a longer-time one shot pulse than that in the first embodiment. In other words, since PMOS 31 is set between the PMOS 32 and the power supply potential Vcc, as the gate of the MOS capacitance capacitor NMOS 34 is progressively charged and the voltage at the node N30 rises, the operation region of the PMOS 32 changes from a saturation region to a non-saturation region to reduce the amount of current flowing the drain and source of the PMOS 32. More specifically, the speed at which the gate of the MOS capacitance capacitor NMOS 34 is charged is lowered. Therefore, if the threshold voltage at the inverter 35 is set higher than the voltage at which the PMOS 32 operates in the non-saturation region, the longer-time one-shot pulse can be generated without enlarging the gate area of the MOS capacitance capacitor NMOS to increase the capacitance value.

Third Embodiment

Figure 3:
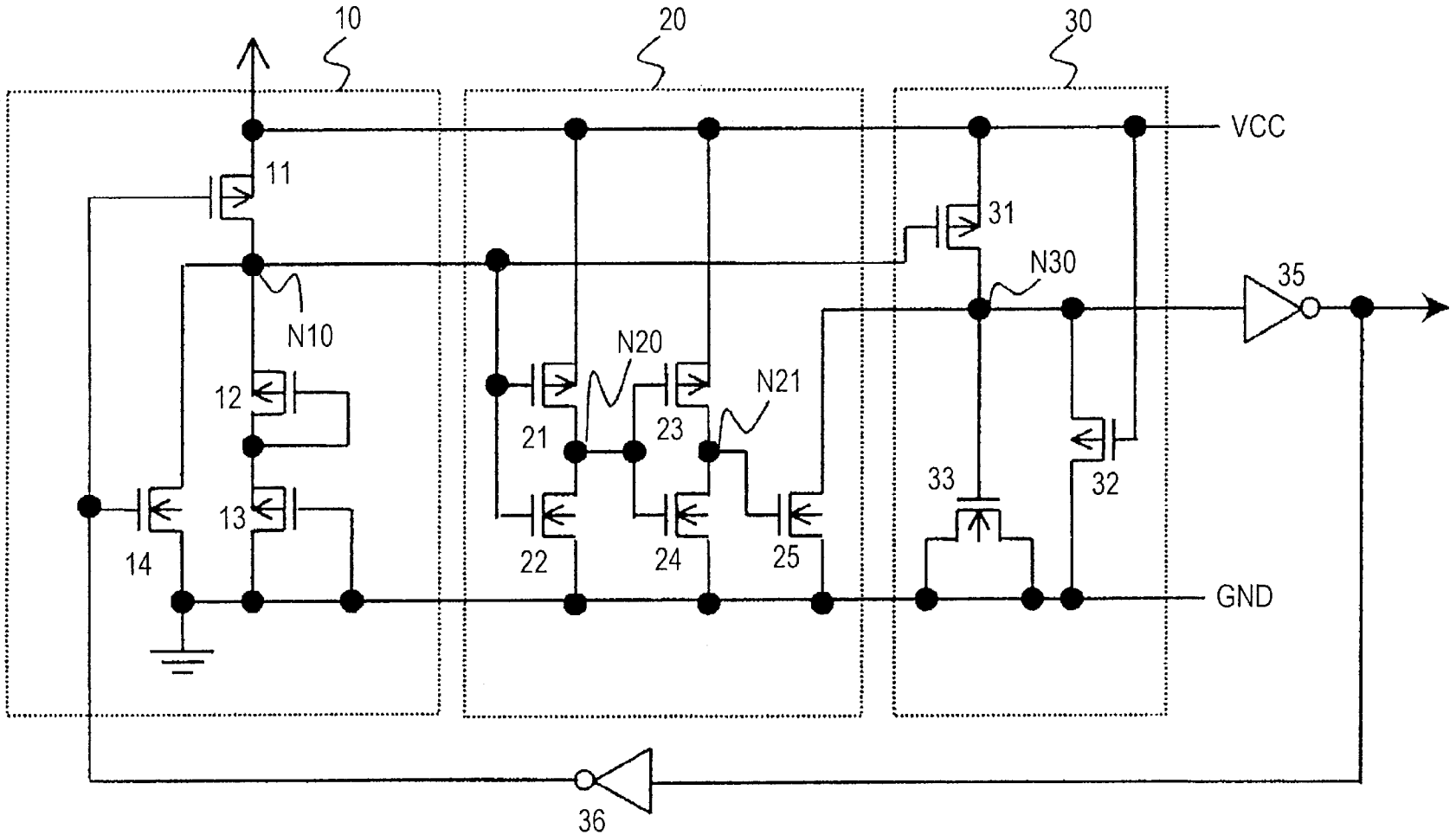
FIG. 3 is an explanatory diagram showing the power-on reset circuit in third embodiment.

FIG. 3 is a circuit diagram of the power-on reset circuit in the third embodiment of the present invention. The power-on reset circuit has a power supply voltage sensing circuit 10, an off-leakage current capacitor charge cutoff circuit 20, a capacitor charge time constant circuit 30, an output circuit 35 and an inverter 36 outputting an inversion signal of the output signal from the output circuit 35 to clamp the operation of the power supply voltage sensing circuit 10 after the output of the one-shot pulse from the output circuit.

The power supply voltage sensing circuit 10 has PMOS 11 the source of which is connected to the first power supply potential Vcc and which functions as an electric current path disconnecting means, PMOS 12 and PMOS 13 which form a rectifier functioning as a voltage sensing means and which are connected between the drain of the PMOS 11 and a ground GND in series, and NMOS 14 to fix the output from the power supply voltage sensing circuit 10 at a ground GND level "L" after the one-shot pulse is output between the drain of the PMOS 11 and the ground GND. The source of the PMOS 12 is connected to the drain of the PMOS 11 and to the gate of the PMOS 12. A connection node N10 of the drain of the PMOS 11 and the source of the PMOS 12 is the output terminal of the power supply voltage sensing circuit 10.

The capacitor charge time constant circuit 30 has PMOS 31 the gate of which is connected to a node N10 and the source of which is connected to the power supply potential Vcc and which functions as an electric current flowing path means, and has PMOS 32 the gate of which is connected to the power supply potential Vcc and which functions as a discharging means. The drain of the PMOS 31 is connected to the source of the PMOS 32 and to the gate of the MOS capacitance capacitor NMOS 33. The drain of the PMOS 32 and the source and drain of the NMOS 33 are connected to the ground GND in common. The gate of the PMOS 32 is connected to the power supply potential Vcc. The connection point of the drain of the PMOS 31, the source of the PMOS 32 and the gate of the NMOS 33 is a second node N30, which is connected to the gate of the PMOS 31 as the output terminal of the capacitor charge time constant circuit 30 and to the input terminal of the inverter 35.

The off-leakage current capacitor charge cutoff circuit 20 has PMOS 21 the gate of which is connected to a node N10 and the source of which is connected to the power supply potential, NMOS 22 the gate of which is connected to a node N10 and the source of which is connected to the ground GND, PMOS 23, the gate of which is connected to a connection node N20 of the drains of the PMOS 21 and NMOS 22 and the source of which is connected to the power supply potential Vcc, NMOS 24 the gate of which is connected to a node N20 and the source of which is connected to the ground GND, and NMOS 25, the gate of which is connected to a connection node N21 of the drains of the PMOS 23 and NMOS 24, the source of which is connected to the ground GND, the drain of which is connected to the node N30 and which cuts off the charge of MOS capacitance capacitor NMOS 33 by the off-leakage current from the PMOS 32.

The inverter 35 is driven by the power supply potential Vcc as the power supply voltage sensing circuit 10, the off-leakage current capacitor charge cutoff circuit 20 and the capacitor charge time constant circuit 30, and an one-shot pulse is output from the output terminal of the inverter 35.

The inverter 36 is driven by the power supply potential Vcc as the power supply voltage sensing circuit 10, the off-leakage current capacitor charge cutoff circuit 20 and the capacitor charge time constant circuit 30, the output-inversion signal from the inverter 35 is input to the gates of the PMOS 11 and NMOS 14 in the power supply voltage sensing circuit 10.

FIGS. 11(*a*)–(*f*) is a waveform diagram showing the operation of the power-on reset circuit in FIG. 3. The operation thereof will be explained in reference to FIGS. 11(*a*)–(*f*).

When the power supply potential Vcc is 0V, the PMOS 32 becomes in the state of diode connection and the electric charge with which the gate of the MOS capacitance capacitor NMOS 33 is charged is discharged through the PMOS 32. Therefore, the voltage of the node N30 becomes less than the threshold voltage Vt32 of the PMOS 32, and is applied to the gate of the PMOS 11 as the feedback voltage. In this state, when the power supply voltage Vcc rises as in FIG. 11(*a*), the inverter 35 outputs H level, the voltage of which rises as the power supply potential Vcc as shown in FIG. 11(*c*). The inverter 36 outputs L level and inputs into the gates of the PMOS 11 and NMOS 14 in the power supply voltage sensing circuit 10. Consequently, the NMOS 14 is turned off.

When the power supply potential Vcc becomes more than the sum of the threshold voltage Vt32 and the threshold voltage Vt11 of the PMOS 11(Vt32+Vt11), the PMOS 32 is turned off, while the PMOS 11 becomes in the status which can be turned on. When the sum of the threshold voltages Vt12 and Vt13 of the two PMOS 12 and 13 (Vt12+Vt13) is set higher than the above sum (Vt32+Vt11), the drain voltage of the PMOS 11 remains clamped by a MOS diode voltage (Vt12+Vt13) configured by the threshold voltages Vt12 and Vt13 of the two PMOS 12 and 13 which are connected to the drain hereof in series. In other words, each PMOS 12 and 13 is not turned on, and the voltage of the node N10 becomes the one almost according to the rise of the power supply potential Vcc. This state continues from the power supply voltage Vcc more than (Vt32+Vt11) to more than (Vt12+Vt13). Therefore, the gate potential of the PMOS 31 becomes almost equal to the power supply potential Vcc and the PMOS 31 remains turned off.

Even though an off-leakage current flows through the PMOS 31 with the gate potential almost equal to the power supply potential Vcc and with the PMOS 31 turned off, the voltage of the node N10 becomes the one almost according to the rise of the power supply potential Vcc. As a result, an node N20 in the off-leakage current capacitor charge cutoff circuit 20 maintains L level, and an node N21 outputs H level, rising as the power supply potential Vcc, as shown in FIG. 11(*b*). Consequently, since the NMOS 25 cutting off the charge of MOS capacitance capacitor NMOS 33 by the off-leakage current from the PMOS 31 is turned on, all the off-leakage current from the PMOS 31 flow into the NMOS 25 as shown in FIG. 11(*e*), and the node N30 maintains a low voltage not inverting the H level in the inverter 35 as shown in FIG. 11(*c*) without charging the gate voltage of the MOS capacitance capacitor NMOS 33 with the off-leakage current at the PMOS 31.

When the power supply voltage Vcc rises to become more than the sum voltage (Vt12+Vt13), the two PMOS 12 and 13 are turned on and current flows through the PMOS 11. Hereby since the node NIO is clamped almost at a constant voltage (Vt12+Vt13) as shown in FIG. 11(*a*), voltage (Vcc–(Vt12+Vt13)) is applied between the source and gate of the PMOS 31. Further when the power supply voltage Vcc rises to become more than the sum of the each threshold voltage Vt12 and Vt13, and the threshold voltage Vt31 of the PMOS 31 (Vt12+Vt13+Vt31), the PMOS 31 becomes completely turned on.

On the other hand, since the relative value to the power supply voltage Vcc of the node N10 voltage goes down, the node N20 potential in the off-leakage current capacitor charge cutoff circuit 20 starts rising as the power supply voltage Vcc rises while the node N21 potential starts going down as the power supply voltage Vcc rises as shown in FIG. 11(*b*). As a result, the NMOS 25 starts being turned off, and the amount of current flowing into the NMOS 25 decreases as shown in FIG. 11(*e*), and finally, the NMOS 25 becomes completely turned off with the rise of the power supply voltage Vcc. When the PMOS 31 is turned on in this state, the current as shown in FIG. 11(*f*) flows through the PMOS 31 and the node N30 voltage rises at the speed of the time constant decided by the gate capacity of the MOS capacitance capacitor NMOS 33. When the node 30 voltage reaches the threshold value at the inverter 35, the output value of the inverter 35 changes from H level to L level as shown in FIG. 11(*c*). Hereby the output of the one-shot pulse, which is started with the rise of the output value H from the inverter 35 is ended with the changed output value L from the inverter 35.

Since the output value of the inverter 36 changes to H level by changing that of the inverter 35 to L level, the PMOS 11 is turned off and the NMOS 14 is turned on. The node N10 voltage is clamped at L level with the NMOS 14 turned on. The PMOS 31 continues to be turned on and the node N30 level is maintained at H level with the node N10 voltage clamped at L level.

As described above, the power-on reset circuit in the third embodiment has the power supply voltage sensing means 10 having the PMOS 11–13 connected in series between the power supply potential Vcc and the ground GND; the capacitor charge time constant circuit 30; the inverter 35; and the inverter 36 outputting an inversion signal of the output signal from the output circuit 35 to clamp the operation of the power supply voltage sensing circuit 10 after the output of the one-shot pulse from the output circuit. In the power-on reset circuit, when the power supply potential Vcc becomes more than the voltage (Vt12+Vt13+Vt31), the gate of the MOS capacitance capacitor NMOS 33 in the capacitor charge time constant circuit 30 is started to be charged. As a result, even when the ramp-up speed of the power supply voltage Vcc is slow, the one-shot power-on reset pulse starting from "H" right after the power application and ending with "L" can be accurately generated. Also, since the PMOS 11 finally becomes turned off after the pulse generation, wasteful current compensation can be eliminated after that. Further, since the charge into the gate of the MOS capacitance capacitor NMOS 33 by the PMOS 31 leakage-current in the PMOS 31 turned-off by setting the off-leakage current capacitor charge cutoff circuit 20 is cut off, the problem that the one-shot pulse cannot be output, caused by using a minute MOS element in which the off-leakage current through the MOS (under high temperature) tends to increase.

Further, the power-on reset circuit in the third embodiment is effective when a wasteful current consumption is desired to be eliminated after the one-shot pulse output in the case of more considerable power noise than in the first embodiment. In other words, in the case of the considerable power noise in the first embodiment, the noise is directly input to the drain of the PMOS 11 in the power supply voltage sensing circuit 10 while a primary power noise through a primary low pass filter configured by the PMOS 31 and MOS capacitance capacitor NMOS 33 in the capacitor charge time constant circuit 30 is input to the gate of the PMOS 11. For this reason, since the power noise and the primary power noise cannot keep in phase each other and have a phase contrast, the fear arises that a wasteful current consumption is generated by flowing a current through the PMOS 11 in the case of a high-frequency power noise. However in the power-on reset circuit in the third embodiment, since the power supply voltage at the gate of the PMOS 11 in the power supply voltage sensing means 10 after the one-shot pulse output is H level output from the inverter 36, the power noises input to the drain and gate of the PMOS 11 can keep in phase. Therefore, the wasteful current consumption can be deleted even in the considerable power noise.

Fourth Embodiment

Figure 4:
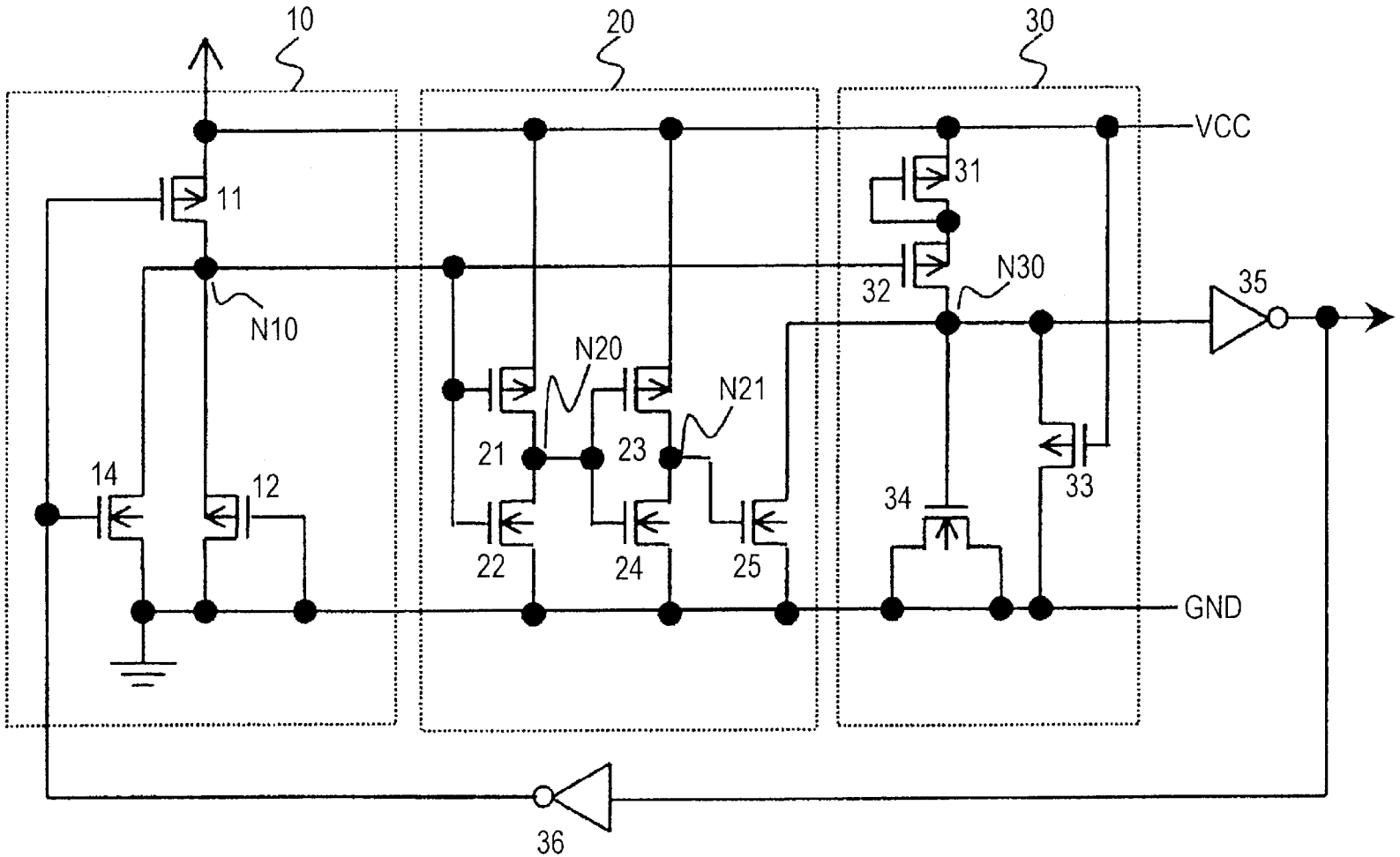
FIG. 4 is an explanatory diagram showing the power-on reset circuit in fourth embodiment.

FIG. 4 is a circuit diagram of the power-on reset circuit in the fourth embodiment of the present invention. The power-on reset circuit has a power supply voltage sensing circuit 10 and a capacitor charge time constant circuit 30, which are different in the configuration from those of the third embodiment, an off-leakage current capacitor charge cutoff circuit 20, an output circuit 35 and an inverter 36 outputting an inversion signal of the output signal from the output circuit 35 to clamp the operation of the power supply voltage sensing circuit 10 after the output of the one-shot pulse from the output circuit.

The power supply voltage sensing circuit 10 has PMOS 11 the source of which is connected to the first power supply potential Vcc and which functions as an electric current path disconnecting means, PMOS 12 which forms a rectifier and which are connected between the drain of the PMOS 11 and a ground GND, and NMOS 14 to fix the output from the power supply voltage sensing circuit 10 at a ground GND level "L" after the one-shot pulse is output between the drain of the PMOS 11 and the ground GND. The source of the PMOS 12 is connected to the drain of the PMOS 11 and the drain and gate of the PMOS 12 is connected to the ground GND. A connection node N10 of the drain of the PMOS 11 and the source of the PMOS 12 is the output terminal of the power supply voltage sensing circuit 10.

The capacitor charge time constant circuit 30 has PMOS 31 the source of which is connected to the power supply potential Vcc and forms rectifier, PMOS 32 the source of which is connected to the drain and gate of the PMOS 31, the gate of which is connected to the node N10, and which functions as an electric current flowing path means, and has PMOS 33 the gate of which is connected to the power supply potential Vcc and which functions as a discharging means. The source of the PMOS 33 is connected to the drain of the PMOS 32 while the drain of the PMOS 33 is connected to the ground GND. A charging MOS capacitance capacitor NMOS 34 is connected between the drain of the PMOS 32 and the ground GND. The connection node N30 of the three points, that is, the drain of the PMOS 32, the source of the PMOS 33 and the gate of a MOS capacitance capacitor NMOS 34, is the output terminal of the capacitor charge time constant circuit 30, and is connected to the input terminal of the inverter 35.

The off-leakage current capacitor charge cutoff circuit 20 has PMOS 21 the gate of which is connected to a node N10 and the source of which is connected to the power supply potential, NMOS 22 the gate of which is connected to a node N10 and the source of which is connected to the ground GND, PMOS 23, the gate of which is connected to a connection node N20 of the drains of the PMOS 21 and NMOS 22 and the source of which is connected to the power supply potential Vcc, NMOS 24 the gate of which is connected to a node N20 and the source of which is connected to the ground GND, and NMOS 25, the gate of which is connected to a connection node N21 of the drains of the PMOS 23 and NMOS 24, the source of which is connected to the ground GND, the drain of which is connected to the node N30 and which cuts off the charge of MOS capacitance capacitor NMOS 33 by the off-leakage current from the PMOS 32.

The inverter 35 is driven by the power supply potential Vcc as the power supply voltage sensing circuit 10, the off-leakage current capacitor charge cutoff circuit 20 and the capacitor charge time constant circuit 30, and an one-shot pulse is output from the output terminal of the inverter 35.

The inverter 36 is driven by the power supply potential Vcc as the power supply voltage sensing circuit 10, the off-leakage current capacitor charge cutoff circuit 20 and the capacitor charge time constant circuit 30, the output-inversion signal from the inverter 35 is input to the gates of the PMOS 11 and NMOS 14 in the power supply voltage sensing circuit 10.

FIGS. 12(*a*)–(*f*) is a waveform diagram showing the operation of the power-on reset circuit in FIG. 4. The operation thereof will be explained in reference to FIGS. 12(*a*)–(*f*).

When the power supply potential Vcc is 0V, the PMOS 33 becomes in the state of diode connection and the electric charge with which the gate of the MOS capacitance capacitor NMOS 34 is charged is discharged through the PMOS 33. Therefore, the voltage of the node N30 becomes less than the threshold voltage Vt32 of the PMOS 33, and is applied to the gate of the PMOS 11 as the feedback voltage. In this state, when the power supply voltage Vcc rises as in FIG. 12(*a*), the inverter 35 outputs H level, the voltage of which rises as the power supply potential Vcc as shown in FIG. 12(*c*). The inverter 36 outputs L level and inputs into the gates of the PMOS 11 and NMOS 14 in the power supply voltage sensing circuit 10. Consequently, the NMOS 14 is turned off.

When the power supply potential Vcc becomes more than the sum of the threshold voltage Vt33 and the threshold voltage Vt11 of the PMOS 11(Vt33+Vt11), the PMOS 33 is turned off, while the PMOS 11 becomes in the status which can be turned on. When the threshold voltage Vt12 of the PMOS 12 is set higher than the above sum (Vt33+Vt11), the drain voltage of the PMOS 11 remains clamped by a MOS diode voltage Vt12 configured by the threshold voltage Vt12 of the PMOS 12 connected to the drain hereof in series. Therefore, the voltage of the node N10 becomes the one almost according to the rise of the power supply potential Vcc and, the gate potential of the PMOS 32 becomes almost equal to the power supply potential Vcc and the PMOS 32 remains turned off.

Even though an off-leakage current flows through the PMOS 32 with the gate potential almost equal to the power supply potential Vcc and with the PMOS 32 turned off, the voltage of the node N10 becomes the one almost according to the rise of the power supply potential Vcc. As a result, an node N20 in the off-leakage current capacitor charge cutoff circuit 20 maintains L level, and an node N21 outputs H level, rising as the power supply potential Vcc, as shown in FIG. 12(*b*). Consequently, since the NMOS 25 cutting off the charge of MOS capacitance capacitor NMOS 34 by the off-leakage current from the PMOS 32 is turned on, all the off-leakage current from the PMOS 32 flow into the NMOS 25 as shown in FIG. 12(*e*), and the node N30 maintains a low voltage not inverting the H level in the inverter 35 as shown in FIG. 12(*c*) without charging the gate voltage of the MOS capacitance capacitor NMOS 34 with the off-leakage current at the PMOS 32.

When the power supply voltage Vcc rises to become more than the sum voltage (Vt12+Vt31) of the threshold voltage Vt12 and the threshold voltage Vt31 of the PMOS 31, voltage (Vcc–(Vt12+Vt31)) is applied between the source and gate of the PMOS 32. Further when the power supply voltage Vcc rises to become more than the sum of the each threshold voltage Vt12 and Vt31, and the threshold voltage Vt32 of the PMOS 32 (Vt12+Vt31+Vt32), the PMOS 32 becomes completely turned on.

On the other hand, since the relative value to the power supply voltage Vcc of the node N10 voltage, the node N20 potential in the off-leakage current capacitor charge cutoff circuit 20 starts rising as the power supply voltage Vcc rises while the node N21 potential starts going down as the power supply voltage Vcc rises as shown in FIG. 12(*b*). As a result, the NMOS 25 starts being turned off, and the amount of current flowing into the NMOS 25 decreases as shown in FIG. 12(*e*), and finally, the NMOS 25 becomes completely turned off with the rise of the power supply voltage Vcc. When the PMOS 32 is turned on in this state, the current as shown in FIG. 12(*f*) flows through the PMOS 32 and the node N30 voltage rises at the speed of the time constant decided by the gate capacity of the MOS capacitance capacitor NMOS 34. When the node 30 voltage reaches the threshold value at the inverter 35, the output value of the inverter 35 changes from H level to L level as shown in FIG. 12(*c*). Hereby the output of the one-shot pulse, which is started with the rise of the output value H from the inverter 35 is ended with the changed output value L from the inverter 35.

Since the output value of the inverter 36 changes to H level by changing that of the inverter 35 to L level, the PMOS 11 is turned off and the NMOS 14 is turned on. The node N10 voltage is clamped at L level with the NMOS 14 turned on. The PMOS 31 continues to be turned on and the node N30 level is maintained at H level with the node N10 voltage clamped at L level.

As described above, the power-on reset circuit in the fourth embodiment has the power supply voltage sensing means 10 having the PMOS 11 and 12 connected in series between the power supply potential Vcc and the ground GND; the capacitor charge time constant circuit 30; the inverter 35; and the inverter 36 outputting an inversion signal of the output signal from the output circuit 35 to clamp the operation of the power supply voltage sensing circuit 10 after the output of the one-shot pulse from the output circuit. In the power-on reset circuit, when the power supply potential Vcc becomes more than the voltage (Vt12+Vt31+Vt32), the gate of the MOS capacitance capacitor NMOS 34 in the capacitor charge time constant circuit 30 is started to be charged. As a result, even when the ramp-up speed of the power supply voltage Vcc is slow, the one-shot power-on reset pulse starting from "H" right after the power application and ending with "H" can be accurately generated. Also, since the PMOS 11 finally becomes turned off after the pulse generation, wasteful current compensation can be eliminated after that. Further, since the charge into the gate of the MOS capacitance capacitor NMOS 34 by the PMOS 32 leakage-current in the PMOS 32 turned-off by setting the off-leakage current capacitor charge cutoff circuit 20 is cut off, the problem that the one-shot pulse cannot be output, caused by using a minute MOS element in which the off-leakage current through the MOS (under high temperature) tends to increase.

Further, the power-on reset circuit in the fourth embodiment is effective, as in the second embodiment, to generate a longer-time one shot pulse than those in the first and third embodiments. In other words, since PMOS 31 is set between the PMOS 32 and the power supply potential Vcc, as the gate of the MOS capacitance capacitor NMOS 34 is progressively charged and the voltage at the node N30 rises, the operation region of the PMOS 32 changes from a saturation region to a non-saturation region to reduce the amount of current flowing the drain and source of the PMOS 32. More specifically, the speed at which the gate of the MOS capacitance capacitor NMOS 34 is charged is lowered. Therefore, if the threshold voltage at the inverter 35 is set higher than the voltage at which the PMOS 32 operates in the non-saturation region, the longer-time one-shot pulse can be generated without enlarging the gate area of the MOS capacitance capacitor NMOS to increase the capacitance value.

Further, the power-on reset circuit in the fourth embodiment is effective, as in the third embodiment, when a wasteful current consumption is desired to be eliminated after the one-shot pulse output in the case of more considerable power noise than in the second embodiment. In other words, in the case of the considerable power noise in the first embodiment, the noise is directly input to the drain of the PMOS 11 in the power supply voltage sensing circuit 10 while a primary power noise through a primary low pass filter configured by the PMOS 31, PMOS 32 and MOS capacitance capacitor NMOS 34 in the capacitor charge time constant circuit 30 is input to the gate of the PMOS 11. For this reason, since the power noise and the primary power noise cannot keep in phase each other and have a phase contrast, the fear arises that a wasteful current consumption is generated by flowing a current through the PMOS 11 in the case of a high-frequency power noise. However in the power-on reset circuit in the third embodiment, since the power supply voltage at the gate of the PMOS 11 in the power supply voltage sensing means 10 after the one-shot pulse output is H level output from the inverter 36, the power noises input to the drain and gate of the PMOS 11 can keep in phase. Therefore, the wasteful current consumption can be deleted even in the considerable power noise.

Fifth Embodiment

Figure 5:
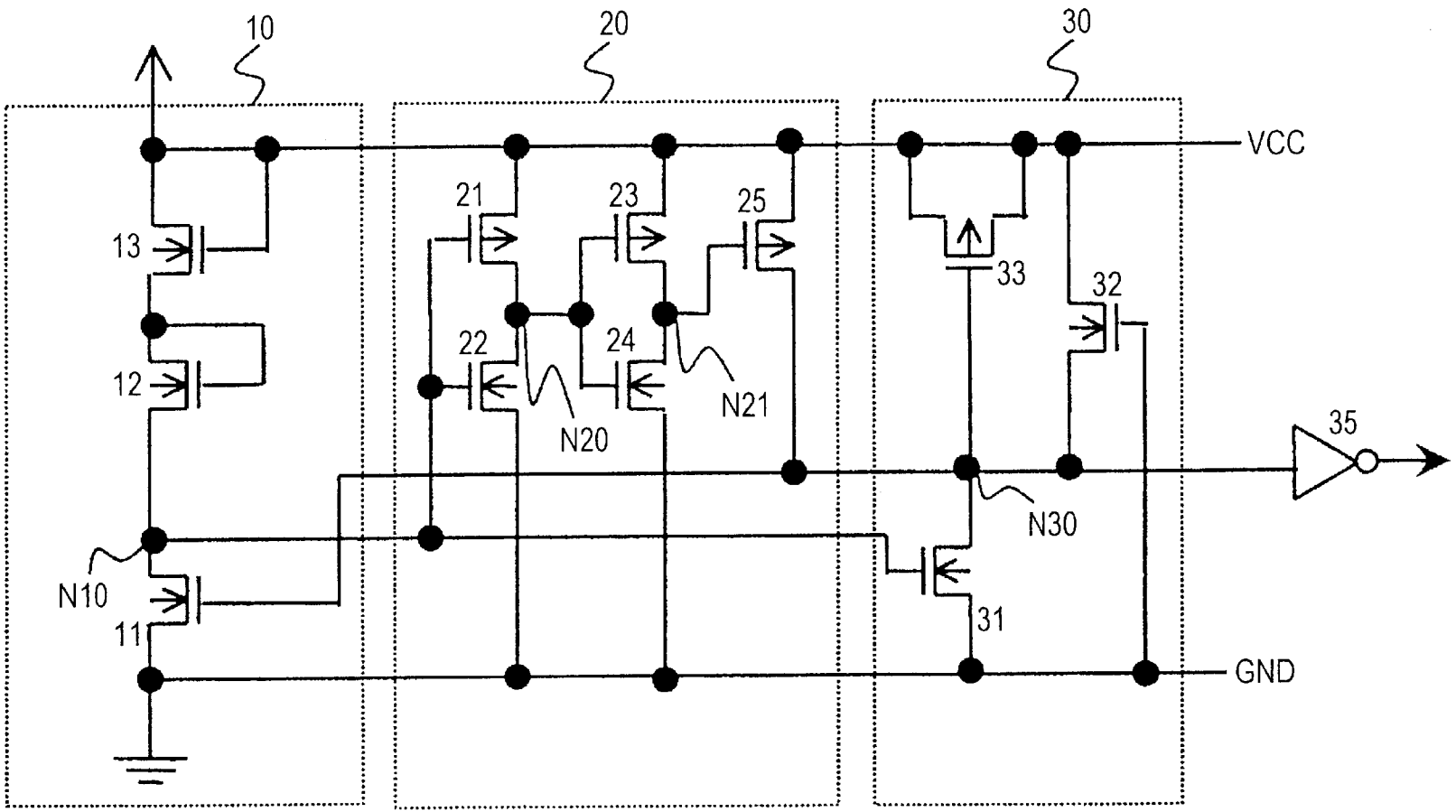
FIG. 5 is an explanatory diagram showing the power-on reset circuit in fifth embodiment.

FIG. 5 is a circuit diagram of the power-on reset circuit in the fifth embodiment of the present invention. The power-on reset circuit has a power supply voltage sensing circuit 10, an off-leakage current capacitor charge cutoff circuit 20, a capacitor charge time constant circuit 30, and an output circuit 35.

The power supply voltage sensing circuit 10 has NMOS 11 the source of which is connected to a ground GND and which functions as an electric current path disconnecting means, NMOS 12 and NMOS 13 which form a rectifier functioning as a voltage sensing means and which are connected between the drain of the NMOS 11 and a power supply potential Vcc in series. The voltage difference between the power supply potential Vcc and the ground GND shows the supplied power supply potential Vcc. The source of the NMOS 13 is connected to the drain of the NMOS 12 and to the gate of the NMOS 12. A connection node N10 of the drain of the NMOS 11 and NMOS 12 is the output terminal of the power supply voltage sensing circuit 10.

The capacitor charge time constant circuit 30 has NMOS 31 the gate of which is connected to a node N10 and the source of which is connected to the ground GND and which functions as an electric current flowing path means, and has NMOS 32 the gate of which is connected to the ground GND and which functions as a discharging means. The drain of the NMOS 31 is connected to the source of the NMOS 32 and to the gate of the MOS capacitance capacitor PMOS 33. The drain of the NMOS 32 and the source and drain of the PMOS 33 are connected to the ground GND in common. The gate of the NMOS 32 is connected to the power supply potential Vcc. The connection point of the drain of the PMOS 31, the source of the NMOS 32 and the gate of the PMOS 33 is a node N30, which is connected to the gate of the NMOS 11 as the output terminal of the capacitor charge time constant circuit 30 and to the input terminal of the inverter 35.

The off-leakage current capacitor charge cutoff circuit 20 has PMOS 21 the gate of which is connected to a node N10 and the source of which is connected to the power supply potential, NMOS 22 the gate of which is connected to a node N10 and the source of which is connected to the ground GND, PMOS 23, the gate of which is connected to a connection node N20 of the drains of the PMOS 21 and NMOS 22 and the source of which is connected to the power supply potential Vcc, NMOS 24 the gate of which is connected to a node N20 and the source of which is connected to the ground GND, and PMOS 25, the gate of which is connected to a connection node N21 of the drains of the PMOS 23 and NMOS 24, the source of which is connected to the power supply potential Vdd, the drain of which is connected to the node N30 and which cuts off the charge of MOS capacitance capacitor NMOS 33 by the off-leakage current from the NMOS 31.

The inverter 35 is driven by the power supply potential Vcc as the power supply voltage sensing circuit 10, the off-leakage current capacitor charge cutoff circuit 20 and the capacitor charge time constant circuit 30, and an one-shot pulse is output from the output terminal of the inverter 35.

FIGS. 13(*a*)–(*f*) is a waveform diagram showing the operation of the power-on reset circuit in FIG. 5. The operation thereof will be explained in reference to FIGS. 13(*a*)–(*f*).

When the power supply potential Vcc is V, the NMOS 32 becomes in the state of diode connection and the electric charge with which the gate of the MOS capacitance capacitor PMOS 33 is charged is discharged through the NMOS 32. Therefore, the voltage difference of the node N30 from the power supply potential Vcc becomes less than the threshold voltage Vt32 of the NMOS 32, and is applied to the gate of the NMOS 11 as the feedback voltage. In this state, even though the power supply voltage Vcc rises as in FIG. 13(*a*), the inverter 35 still outputs L level. When the power supply potential Vcc becomes more than the sum of the threshold voltage Vt32 and the threshold voltage Vt11 of the NMOS 11(Vt32+Vt11), the NMOS 32 is turned off, while the NMOS 11 becomes in the status which can be turned on. When the sum of the threshold voltages Vt12 and Vt13 of the two NMOS 12 and 13(Vt12+Vt13) is set higher than the above sum (Vt32+Vt11), the voltage difference of the drain of the NMOS 11 from the power supply potential Vcc remains clamped by a MOS diode voltage (Vt12+Vt13) configured by the threshold voltages Vt12 and Vt13 of the two NMOS 12 and 13 which are connected to the drain hereof in series. In other words, each NMOS 12 and 13 is not turned on, and the voltage of the node N10 becomes almost the same as the ground GND voltage. This state continues from the power supply voltage Vcc more than (Vt32+Vt11) to more than (Vt12+Vt13). Therefore, the gate potential of the NMOS 31 becomes almost equal to the ground GND voltage and the NMOS 31 remains turned off.

Even though an off-leakage current flows through the NMOS 31 with the gate potential almost equal to the power supply potential Vcc and with the NMOS 31 turned off, the voltage of the node N10 becomes almost the same as the ground GND voltage. As a result, an node N20 in the off-leakage current capacitor charge cutoff circuit 20 maintains H level rising with the rise of the power supply potential Vcc, and an node N21 outputs ground GND L level, as shown in FIG. 13(*b*). Consequently, since the PMOS 25 cutting off the charge of MOS capacitance capacitor PMOS 33 by the off-leakage current from the NMOS 31 is turned on, all the off-leakage current from the NMOS 31 flow into the PMOS 25 as shown in FIG. 13(*e*), and the node N30 maintains the H level not inverting the L level in the inverter 35 and rising with the rise of the power supply voltage Vcc as shown in FIG. 13(*c*) without charging the gate voltage of the MOS capacitance capacitor PMOS 33 with the off-leakage current at the NMOS 31.

When the power supply voltage Vcc rises to become more than the sum voltage (Vt12+Vt13), the two NMOS 12 and 13 are turned on and current flows through the NMOS 11. Hereby since the voltage difference of the node N10 from the power supply potential Vcc is clamped almost at a constant voltage (Vt12+Vt13) as shown in FIG. 13 (*a*), voltage (Vcc−(Vt12+Vt13)) is applied between the source and gate of the NMOS 31. Further when the power supply voltage Vcc rises to become more than the sum of the each threshold voltage Vt12 and Vt13, and the threshold voltage Vt31 of the NMOS 31 (Vt12+Vt13+Vt31), the NMOS 31 becomes completely turned on.

On the other hand, since the relative value to the power supply voltage Vcc of the node N10 voltage rises, the node N20 potential in the off-leakage current capacitor charge cutoff circuit 20 starts going down as the power supply voltage Vcc rises while the node N21 potential starts rising as the power supply voltage Vcc rises as shown in FIG. 13(*b*). As a result, the PMOS 25 starts being turned off, and the amount of current flowing into the PMOS 25 decreases as shown in FIG. 13(*e*), and finally, the PMOS 25 becomes completely turned off with the rise of the power supply voltage Vcc. When the NMOS 31 is turned on in this state, the current as shown in FIG. 13(*f*) flows through the NMOS 31 and the node N30 voltage goes down at the speed of the time constant decided by the gate capacity of the MOS capacitance capacitor PMOS 33. When the node 30 voltage reaches the threshold value at the inverter 35, the output value of the inverter 35 changes from L level to H level as shown in FIG. 13(*c*). Hereby the output of the one-shot pulse, which is started with the L level of the output value H from the inverter 35 is ended with the changed output value H from the inverter 35. As the charge of the gate capacitance of the MOS capacitance capacitor PMOS 33 progresses and the node N30 voltage further goes down, the gate potential of the NMOS 11 goes down and the voltage between the gate and source becomes low, and finally, the NMOS 11 is turned off as shown in FIG. 13(*d*). Hereby the node N10 voltage rises. Along with the rise of the node N10 voltage, the NMOS 31 remains turned on to maintain the node N30 level at L level.

As described above, the power-on reset circuit in the fifth embodiment has the power supply voltage sensing means 10 having the NMOS 11–13 connected in series between the power supply potential Vcc and the ground GND; the capacitor charge time constant circuit 30; and the inverter 35. In the power-on reset circuit, when the power supply potential Vcc becomes more than the voltage (Vt12+Vt13+Vt31), the gate of the MOS capacitance capacitor PMOS 33 in the capacitor charge time constant circuit 30 is started to be charged. As a result, even when the ramp-up speed of the power supply voltage Vcc is slow, the one-shot power-on reset pulse starting from "L" right after the power application and ending with "H" can be accurately generated. Also, since the NMOS 11 finally becomes turned off after the pulse generation, wasteful current compensation can be eliminated after that. Further, since the charge into the gate of the MOS capacitance capacitor PMOS 33 by the NMOS 31 leakage-current in the NMOS 31 turned-off by setting the off-leakage current capacitor charge cutoff circuit 20 is cut off, the problem that the one-shot pulse cannot be output, caused by using a minute MOS element in which the off-leakage current through the MOS (under high temperature) tends to increase.

The power-on reset circuit in the first embodiment generates the one-shot power-on reset pulse starting from "H" right after the power application and ending with "L", however, the power-on reset circuit in the fifth embodiment generates the one-shot power-on reset pulse starting from "L" right after the power application and ending with "H". Therefore, when an "L" active power-on reset pulse is needed, it is necessary to set an inverter on the output side of the power-on reset circuit in the first embodiment, however, the inverter is not needed in the power-on reset circuit in the fifth embodiment.

Sixth Embodiment

Figure 6:
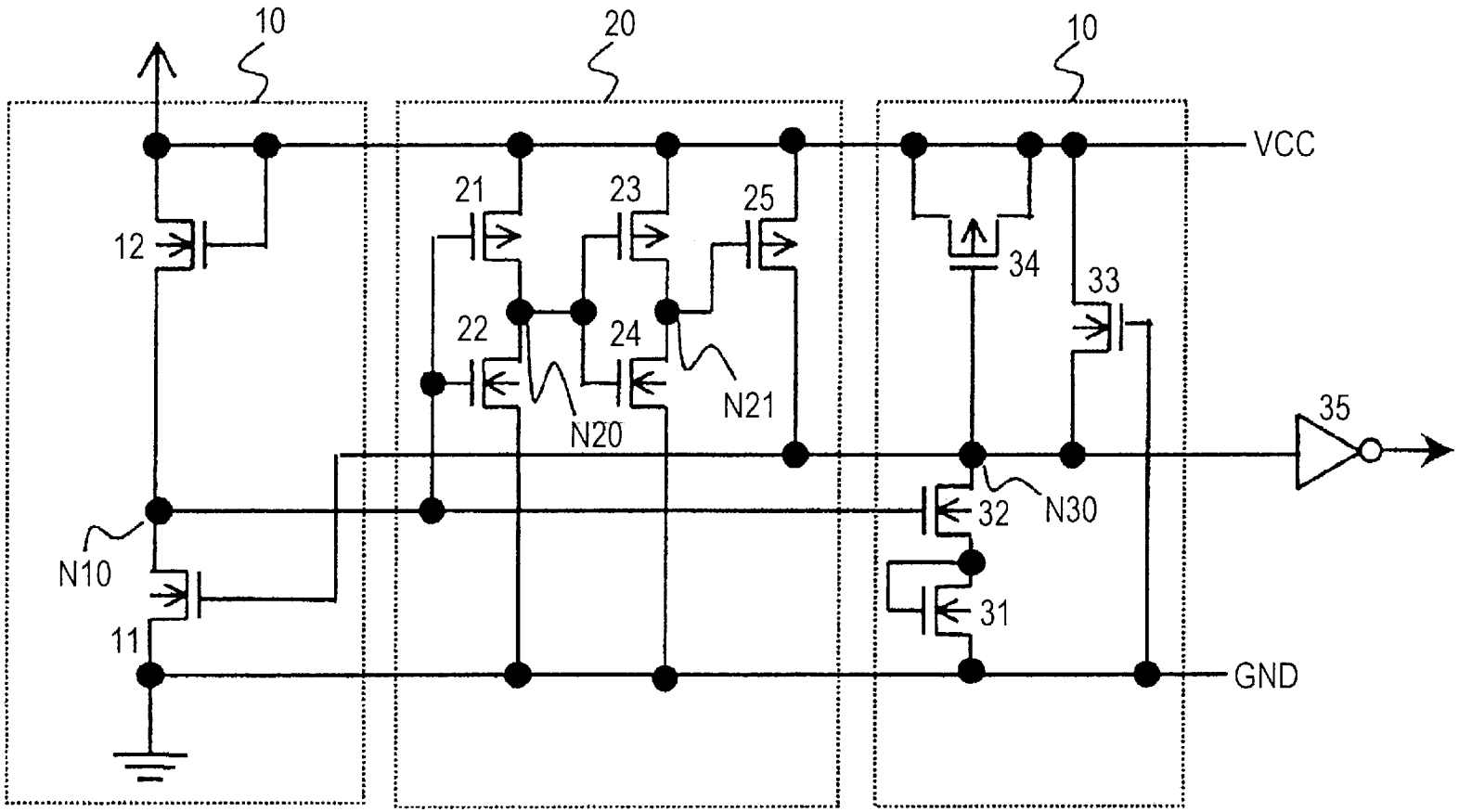
FIG. 6 is an explanatory diagram showing the power-on reset circuit in sixth embodiment.

FIG. 6 is a circuit diagram of the power-on reset circuit in the sixth embodiment of the present invention. The power-on reset circuit has a power supply voltage sensing circuit 10 and a capacitor charge time constant circuit 30, which are different in the configuration from those of the fifth embodiment, an off-leakage current capacitor charge cutoff circuit 20, and an output circuit 35.

The power supply voltage sensing circuit 10 has NMOS 11 the source of which is connected to a ground GND and which functions as an electric current path disconnecting means, NMOS 12 which forms a rectifier and which is connected between the drain of the NMOS 11 and a power supply potential Vcc. The source of the NMOS 12 is connected to the drain of the PMOS 11 and the drain and gate of the NMOS 12 are connected to the power supply potential Vcc. A connection node N10 of the drain of the NMOS 11 and the source of the NMOS 12 is the output terminal of the power supply voltage sensing circuit 10.

The capacitor charge time constant circuit 30 has NMOS 31 the source of which is connected to the ground GND and forms rectifier, NMOS 32 the source of which is connected to the drain and gate of the NMOS 31, the gate of which is connected to the node NIO, and which functions as an electric current flowing path means, and has NMOS 33 the gate of which is connected to the ground GND and which functions as a discharging means. The source of the NMOS 33 is connected to the drain of the NMOS 32 while the drain of the NMOS 33 is connected to the power supply potential Vcc. A charging MOS capacitance capacitor PMOS 34 is connected between the drain of the NMOS 32 and the power supply potential Vcc. The connection node N30 of the three points, that is, the drain of the NMOS 32, the source of the NMOS 33 and the gate of a MOS capacitance capacitor PMOS 34, is the output terminal of the capacitor charge time constant circuit 30, and is connected to the gate of the NMOS 11 and to the input terminal of the inverter 35.

The off-leakage current capacitor charge cutoff circuit 20 has PMOS 21 the gate of which is connected to a node N10 and the source of which is connected to the power supply potential, NMOS 22 the gate of which is connected to a node N10 and the source of which is connected to the ground GND, PMOS 23, the gate of which is connected to a connection node N20 of the drains of the PMOS 21 and NMOS 22 and the source of which is connected to the power supply potential Vcc, NMOS 24 the gate of which is connected to a node N20 and the source of which is connected to the ground GND, and PMOS 25, the gate of which is connected to a connection node N21 of the drains of the PMOS 23 and NMOS 24, the source of which is connected to the power supply potential Vcc, the drain of which is connected to the node N30 and which cuts off the charge of MOS capacitance capacitor PMOS 33 by the off-leakage current from the NMOS 31.

The inverter 35 is driven by the power supply potential Vcc as the power supply voltage sensing circuit 10, the off-leakage current capacitor charge cutoff circuit 20 and the capacitor charge time constant circuit 30, and an one-shot pulse is output from the output terminal of the inverter 35.

FIGS. 14(*a*)–(*f*) is a waveform diagram showing the operation of the power-on reset circuit in FIG. 6. The operation thereof will be explained in reference to FIGS. 14(*a*)–(*f*).

When the power supply potential Vcc is 0V, the NMOS 33 becomes in the state of diode connection and the electric charge with which the gate of the MOS capacitance capacitor PMOS 34 is charged is discharged through the NMOS 33. Therefore, the voltage difference of the node N30 from the power supply potential Vcc becomes less than the threshold voltage Vt32 of the NMOS 33, and is applied to the gate of the NMOS 11 as the feedback voltage. In this state, even though the power supply voltage Vcc rises as in FIG. 14(*a*), the inverter 35 still outputs L level. When the power supply potential Vcc becomes more than the sum of the threshold voltage Vt33 and the threshold voltage Vt11 of the NMOS 11(Vt33+Vt11), the NMOS 33 is turned off, while the NMOS 11 becomes in the status which can be turned on. When the sum of the threshold voltage Vt12 of the NMOS 12 is set higher than the above sum (Vt33+Vt11), the voltage difference of the drain of the NMOS 11 from the power supply potential Vcc remains clamped by a MOS diode voltage Vt12 configured by the threshold voltage Vt12 of the NMOS 12 which are connected to the drain hereof in series. Therefore, the voltage of the node N10 becomes almost the same as the ground GND voltage while the gate potential of the NMOS 32 becomes almost equal to the ground GND voltage and the NMOS 32 remains turned off.

Even though an off-leakage current flows through the NMOS 32 with the gate potential almost equal to the power supply potential Vcc and with the NMOS 32 turned off, the voltage of the node N10 becomes almost the same as the ground GND voltage. As a result, an node N20 in the off-leakage current capacitor charge cutoff circuit 20 maintains H level rising with the rise of the power supply voltage Vcc, and an node N21 outputs ground GND L level, as shown in FIG. 14(*b*). Consequently, since the PMOS 25 cutting off the charge of MOS capacitance capacitor PMOS 34 by the off-leakage current from the NMOS 32 is turned on, all the off-leakage current from the NMOS 32 flow into the PMOS 25 as shown in FIG. 14(*e*), and the node N30 maintains the H level not inverting the L level in the inverter 35 and rising with the rise of the power supply voltage Vcc as shown in FIG. 14(*c*) without charging the gate voltage of the MOS capacitance capacitor PMOS 34 with the off-leakage current at the NMOS 32.

When the power supply voltage Vcc rises to become more than the sum voltage (Vt12+Vt31) of the threshold voltage Vt12 and the threshold voltage Vt31 of the NMOS 31, voltage (Vcc–(Vt12+Vt31)) is applied between the source and gate of the NMOS 32. Further when the power supply voltage Vcc rises to become more than the sum of the each threshold voltage Vt12 and Vt31, and the threshold voltage Vt32 of the PMOS 32 (Vt12+Vt31+Vt32), the NMOS 32 becomes completely turned on.

On the other hand, since the relative value to the power supply voltage Vcc of the node N10 voltage rises, the node N20 potential in the off-leakage current capacitor charge cutoff circuit 20 starts going down as the power supply voltage Vcc rises while the node N21 potential starts rising as the power supply voltage Vcc rises as shown in FIG. 14(*b*). As a result, the PMOS 25 starts being turned off, and the amount of current flowing into the PMOS 25 decreases as shown in FIG. 14(*e*), and finally, the PMOS 25 becomes completely turned off with the rise of the power supply voltage Vcc. When the NMOS 32 is turned on in this state, the current as shown in FIG. 14(*f*) flows through the NMOS 32 and the node N30 voltage goes down at the speed of the time constant decided by the gate capacity of the MOS capacitance capacitor PMOS 34. When the node 30 voltage reaches the threshold voltage at the inverter 35, the output value of the inverter 35 changes from L level to H level as shown in FIG. 14(*c*). Hereby the output of the one-shot pulse, which is started with the L level of the output value H from the inverter 35 is ended with the changed output value H from the inverter 35. As the charge of the gate capacitance of the MOS capacitance capacitor PMOS 34 progresses and the node N30 voltage further goes down, the gate potential of the NMOS 11 goes down and the voltage between the gate and source becomes low, and finally, the NMOS 11 is turned off as shown in FIG. 14(*d*). Hereby the node N10 voltage rises. Along with the rise of the node N10 voltage, the NMOS 32 remains turned on to maintain the node N30 level at L level.

As described above, the power-on reset circuit in the sixth embodiment has the power supply voltage sensing means 10 having the NMOS 11 and 12 connected in series between the power supply potential Vcc and the ground GND; the capacitor charge time constant circuit 30; and the inverter 35. In the power-on reset circuit, when the power supply potential Vcc becomes more than the voltage (Vt12+Vt31+Vt32), the gate of the MOS capacitance capacitor PMOS 34 in the capacitor charge time constant circuit 30 is started to be charged. As a result, even when the ramp-up speed of the power supply voltage Vcc is slow, the one-shot power-on reset pulse starting from "L" right after the power application and ending with "H" can be accurately generated. Also, since the NMOS 11 finally becomes turned off after the pulse generation, wasteful current compensation can be eliminated after that. Further, since the charge into the gate of the MOS capacitance capacitor PMOS 34 by the NMOS 32 leakage-current in the NMOS 32 turned-off by setting the off-leakage current capacitor charge cutoff circuit 20 is cut off, the problem that the one-shot pulse cannot be output, caused by using a minute MOS element in which the off-leakage current through the MOS (under high temperature) tends to increase.

Further, the power-on reset circuit in the sixth embodiment is effective to generate a longer-time one shot pulse than that in the fifth embodiment. In other words, since NMOS 31 is set between the NMOS 32 and the ground GND, as the gate of the MOS capacitance capacitor PMOS 34 is progressively charged and the voltage at the node N30 goes down, the operation region of the NMOS 32 changes from a saturation region to a non-saturation region to reduce the amount of current flowing the drain and source of the PMOS 32. More specifically, the speed at which the gate of the MOS capacitance capacitor PMOS 34 is charged is lowered. Therefore, if the threshold voltage at the inverter 35 is set higher than the voltage at which the NMOS 32 operates in the non-saturation region, the longer-time one-shot pulse can be generated without enlarging the gate area of the MOS capacitance capacitor NMOS to increase the capacitance value.

The power-on reset circuit in the second embodiment generates the one-shot power-on reset pulse starting from "H" right after the power application and ending with "L", however, the power-on reset circuit in the sixth embodiment generates the one-shot power-on reset pulse starting from "L" right after the power application and ending with "H". Therefore, when an "L" active power-on reset pulse is needed, it is necessary to set an inverter on the output side of the power-on reset circuit in the first embodiment, however, the inverter is not needed in the power-on reset circuit in the sixth embodiment.

Seventh Embodiment

Figure 7:
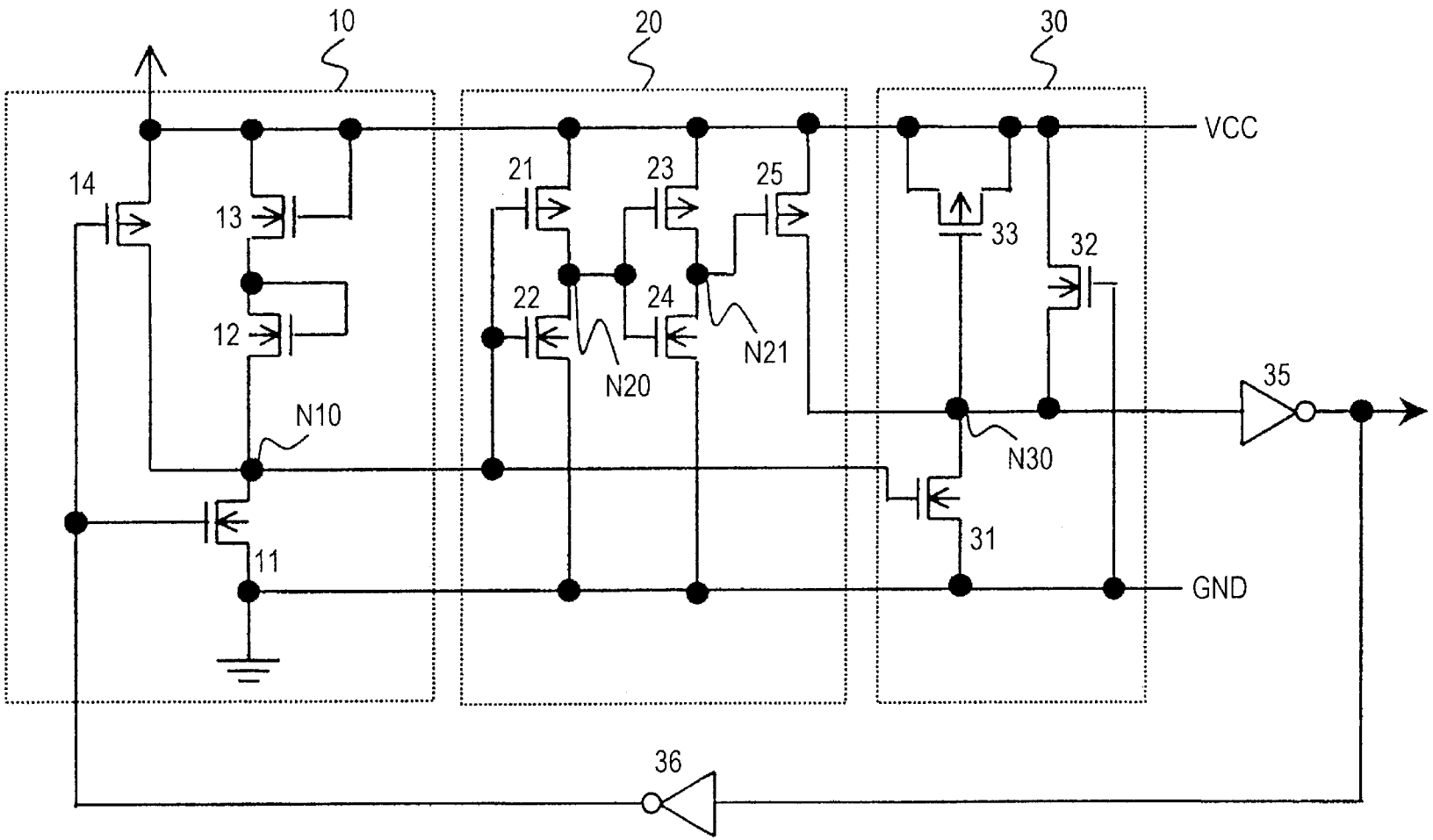
FIG. 7 is an explanatory diagram showing the power-on reset circuit in seventh embodiment.

FIG. 7 is a circuit diagram of the power-on reset circuit in the seventh embodiment of the present invention. The power-on reset circuit has a power supply voltage sensing circuit 10, an off-leakage current capacitor charge cutoff circuit 20, a capacitor charge time constant circuit 30, an output circuit 35 and an inverter 36 outputting an inversion signal of the output signal from the output circuit 35 to clamp the operation of the power supply voltage sensing circuit 10 after the output of the one-shot pulse from the output circuit.

The power supply voltage sensing circuit 10 has NMOS 11 the source of which is connected to the ground GND and which functions as an electric current path disconnecting means, NMOS 12 and NMOS 13 which form a rectifier functioning as a voltage sensing means and which are connected between the drain of the NMOS 11 and a power supply potential Vcc in series, and PMOS 14 to fix the output from the power supply voltage sensing circuit 10 at a power supply potential Vcc level "H" after the one-shot pulse is output between the drain of the PMOS 11 and the power supply potential Vcc. The source of the NMOS 12 is connected to the drain of the NMOS 11 and to the gate of the NMOS 12. A connection node N10 of the drain of the NMOS 11 and the source of the NMOS 12 is the output terminal of the power supply voltage sensing circuit 10.

The capacitor charge time constant circuit 30 has NMOS 31 the gate of which is connected to a node N10 and the source of which is connected to the ground GND and which functions as an electric current flowing path means, and has NMOS 32 the gate of which is connected to the ground GND and which functions as a discharging means. The drain of the NMOS 31 is connected to the source of the NMOS 32 and to the gate of the MOS capacitance capacitor PMOS 33. The drain of the NMOS 32 and the source and drain of the PMOS 33 are connected to the ground GND in common. The gate of the NMOS 32 is connected to the power supply potential Vcc. The connection point of the drain of the PMOS 31, the source of the NMOS 32 and the gate of the PMOS 33 is a node N30, which is connected to the gate of the NMOS 11 as the output terminal of the capacitor charge time constant circuit 30 and to the input terminal of the inverter 35.

The off-leakage current capacitor charge cutoff circuit 20 has PMOS 21 the gate of which is connected to a node N10 and the source of which is connected to the power supply potential, NMOS 22 the gate of which is connected to a node N10 and the source of which is connected to the ground GND, PMOS 23, the gate of which is connected to a connection node N20 of the drains of the PMOS 21 and NMOS 22 and the source of which is connected to the power supply potential Vcc, NMOS 24 the gate of which is connected to a node N20 and the source of which is connected to the ground GND, and PMOS 25, the gate of which is connected to a connection node N21 of the drains of the PMOS 23 and NMOS 24, the source of which is connected to the power supply potential Vcc, the drain of which is connected to the node N30 and which cuts off the charge of MOS capacitance capacitor NMOS 33 by the off-leakage current from the NMOS 31.

The inverter 35 is driven by the power supply potential Vcc as the power supply voltage sensing circuit 10, the off-leakage current capacitor charge cutoff circuit 20 and the capacitor charge time constant circuit 30, and an one-shot pulse is output from the output terminal of the inverter 35.

The inverter 36 is driven by the power supply potential Vcc as the power supply voltage sensing circuit 10, the off-leakage current capacitor charge cutoff circuit 20 and the capacitor charge time constant circuit 30, the output-inversion signal from the inverter 35 is input to the gates of the PMOS 11 and NMOS 14 in the power supply voltage sensing circuit 10.

FIGS. 15(*a*)–(*f*) is a waveform diagram showing the operation of the power-on reset circuit in FIG. 7. The operation thereof will be explained in reference to FIGS. 15(*a*)–(*f*).

When the power supply potential Vcc is 0V, the NMOS 32 becomes in the state of diode connection and the electric charge with which the gate of the MOS capacitance capacitor PMOS 33 is charged is discharged through the NMOS 32. Therefore, the voltage difference of the node N30 from the power supply potential Vcc becomes less than the threshold voltage Vt32 of the NMOS 32. In this state, even though the power supply voltage Vcc rises as in FIG. 15(*a*), the inverter 35 still outputs L level. The inverter 36 outputs L level rising with the rise of the power supply potential Vcc and inputs into the gates of the NMOS 11 and PMOS 14 in the power supply voltage sensing circuit 10. Consequently, the PMOS 14 is turned off.

When the power supply potential Vcc becomes more than the sum of the threshold voltage Vt32 and the threshold voltage Vt11 of the NMOS 11(Vt32+Vt11), the NMOS 32 is turned off, while the NMOS 11 becomes in the status which can be turned on. When the sum of the threshold voltages Vt12 and Vt13 of the two NMOS 12 and 13(Vt12+Vt13) is set higher than the above sum (Vt32+Vt11), the voltage difference of the drain of the NMOS 11 from the power supply potential Vcc remains clamped by a MOS diode voltage (Vt12+Vt13) configured by the threshold voltages Vt12 and Vt13 of the two NMOS 12 and 13 which are connected to the drain hereof in series. In other words, each NMOS 12 and 13 is not turned on, and the voltage of the node N10 becomes almost the same as the ground GND voltage. This state continues from the power supply voltage Vcc more than (Vt32+Vt11) to more than (Vt12+Vt13). Therefore, the gate potential of the NMOS 31 becomes almost equal to the ground GND voltage and the NMOS 31 remains turned off.

Even though an off-leakage current flows through the NMOS 31 with the gate potential almost equal to the power supply potential Vcc and with the NMOS 31 turned off, the voltage of the node N10 becomes almost the same as the ground GND voltage. As a result, an node N20 in the off-leakage current capacitor charge cutoff circuit 20 maintains H level rising with the rise of the power supply voltage Vcc, and an node N21 outputs ground GND L level, as shown in FIG. 15(*b*). Consequently, since the PMOS 25 cutting off the charge of MOS capacitance capacitor PMOS 33 by the off-leakage current from the NMOS 31 is turned on, all the off-leakage current from the NMOS 31 flow into the PMOS 25 as shown in FIG. 15(*e*), and the node N30 maintains the H level not inverting the L level in the inverter 35 and rising with the rise of the power supply voltage Vcc as shown in FIG. 15(*c*) without charging the gate voltage of the MOS capacitance capacitor PMOS 33 with the off-leakage current at the NMOS 31.

When the power supply voltage Vcc rises to become more than the sum voltage (Vt12+Vt13), the two NMOS 12 and 13 are turned on and current flows through the NMOS 11. Hereby since the voltage difference of the node N10 from the power supply potential Vcc is clamped almost at a constant voltage (Vt12+Vt13) as shown in FIG. 15(*a*), voltage (Vcc−(Vt12+Vt13)) is applied between the source and gate of the NMOS 31. Further when the power supply voltage Vcc rises to become more than the sum of the each threshold voltage Vt12 and Vt13, and the threshold voltage Vt31 of the NMOS 31 (Vt12+Vt13+Vt31), the NMOS 31 becomes completely turned on.

On the other hand, since the relative value to the power supply voltage Vcc of the node N10 voltage rises, the node N20 potential in the off-leakage current capacitor charge cutoff circuit 20 starts going down as the power supply voltage Vcc rises while the node N21 potential starts rising as the power supply voltage Vcc rises as shown in FIG. 15(*b*). As a result, the PMOS 25 starts being turned off, and the amount of current flowing into the PMOS 25 decreases as shown in FIG. 15(*e*), and finally, the PMOS 25 becomes completely turned off with the rise of the power supply voltage Vcc. When the NMOS 31 is turned on in this state, the current as shown in FIG. 15(f flows through the NMOS 31 and the node N30 voltage goes down at the speed of the time constant decided by the gate capacity of the MOS capacitance capacitor PMOS 33. When the node 30 voltage reaches the threshold value at the inverter 35, the output value of the inverter 35 changes from L level to H level as shown in FIG. 15(*c*). Hereby the output of the one-shot pulse, which is started with the L level of the output value H from the inverter 35 is ended with the changed output value H from the inverter 35.

Since the output value of the inverter 36 changes to L level by changing that of the inverter 35 to H level, the NMOS 11 is turned off and the PMOS 14 is turned on. The node N10 voltage is clamped at H level with the PMOS 14 turned on. The NMOS 31 continues to be turned on and the node N30 level is maintained at L level with the node N10 voltage clamped at H level.

As described above, the power-on reset circuit in the seventh embodiment has the power supply voltage sensing means 10 having the NMOS 11–13 connected in series between the power supply potential Vcc and the ground GND; the capacitor charge time constant circuit 30; the inverter 35 and the inverter 36 outputting an inversion signal of the output signal from the output circuit 35 to clamp the operation of the power supply voltage sensing circuit 10 after the output of the one-shot pulse from the output circuit. In the power-on reset circuit, when the power supply potential Vcc becomes more than the voltage (Vt12+Vt13+Vt31), the gate of the MOS capacitance capacitor PMOS 33 in the capacitor charge time constant circuit 30 is started to be charged. As a result, even when the ramp-up speed of the power supply voltage Vcc is slow, the one-shot power-on reset pulse starting from "L" right after the power application and ending with "H" can be accurately generated. Also, since the NMOS 11 finally becomes turned off after the pulse generation, wasteful current compensation can be eliminated after that. Further, since the charge into the gate of the MOS capacitance capacitor PMOS 33 by the NMOS 31 leakage-current in the NMOS 31 turned-off by setting the off-leakage current capacitor charge cutoff circuit 20 is cut off, the problem that the one-shot pulse cannot be output, caused by using a minute MOS element in which the off-leakage current through the MOS (under high temperature) tends to increase.

Further, the power-on reset circuit in the seventh embodiment is effective when a wasteful current consumption is desired to be eliminated after the one-shot pulse output in the case of more considerable GND noise than in the fifth embodiment. In other words, in the case of the considerable GND noise in the fifth embodiment, the noise is directly input to the source of the PMOS 11 in the power supply voltage sensing circuit 10 while a primary lag GND noise through a primary low pass filter configured by the NMOS 31 and MOS capacitance capacitor PMOS 33 in the capacitor charge time constant circuit 30 is input to the gate of the NMOS 11. For this reason, since the GND noise and the primary lag GND noise cannot keep in phase each other and have a phase contrast, the fear arises that a wasteful current consumption is generated by flowing a current through the NMOS 11 in the case of a high-frequency GND noise. However in the power-on reset circuit in the seventh embodiment, since the power supply voltage at the gate of the NMOS 11 in the power supply voltage sensing means 10 after the one-shot pulse output is L level output from the inverter 36, the GND noises input to the drain and gate of the NMOS 11 can keep in phase. Therefore, the wasteful current consumption can be deleted even in the considerable GND noise.

Eighth Embodiment

Figure 8:
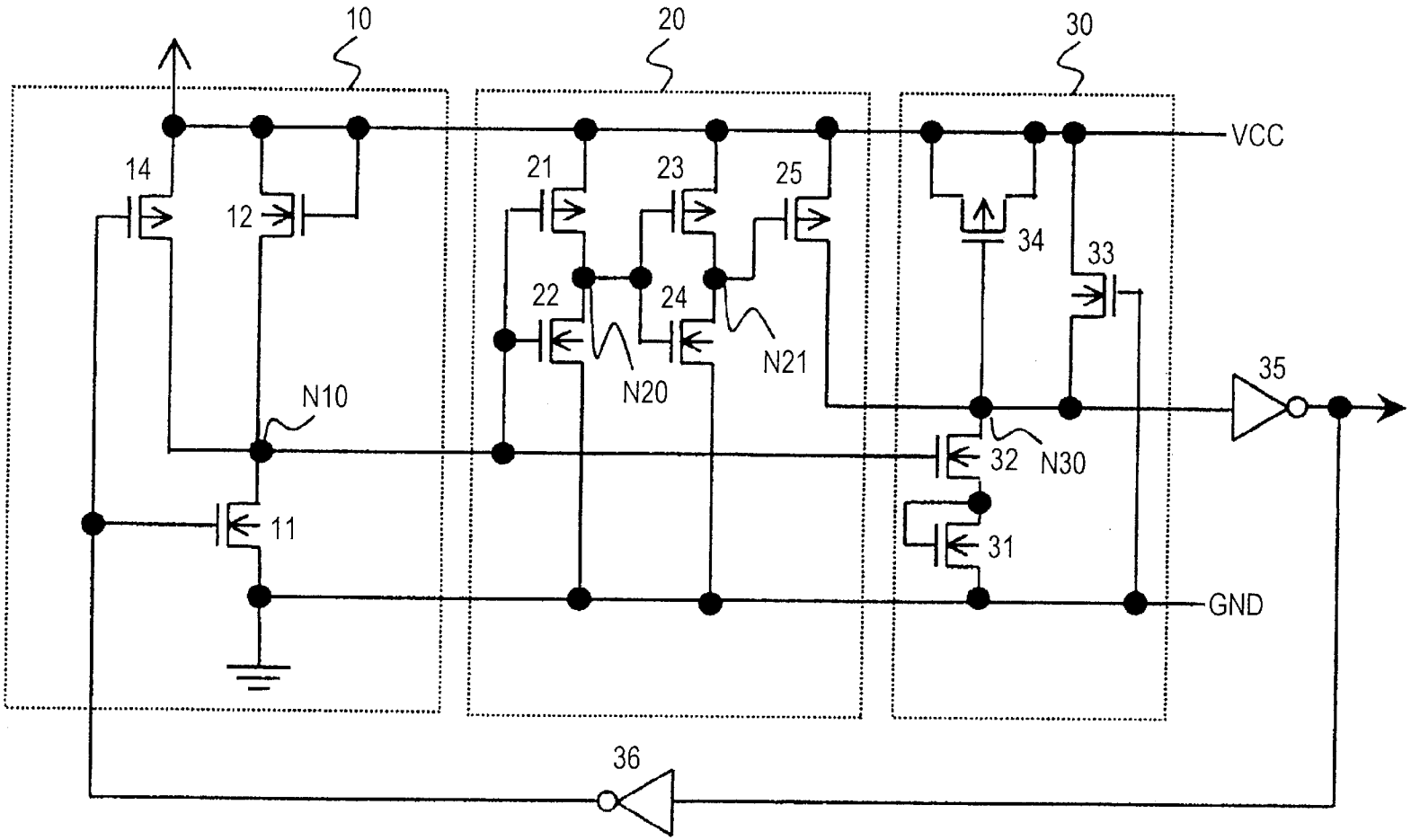
FIG. 8 is an explanatory diagram showing the power-on reset circuit in eighth embodiment.
Figure 9A:
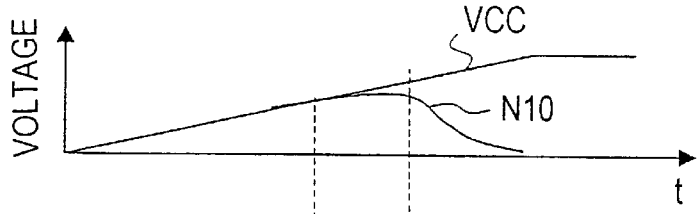
FIG. 9 is an explanatory diagram showing the waveform operation of the power-on reset circuit in FIG. 1.
Figure 9B:
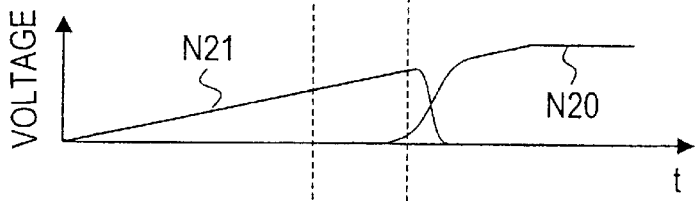
Figure 9C:
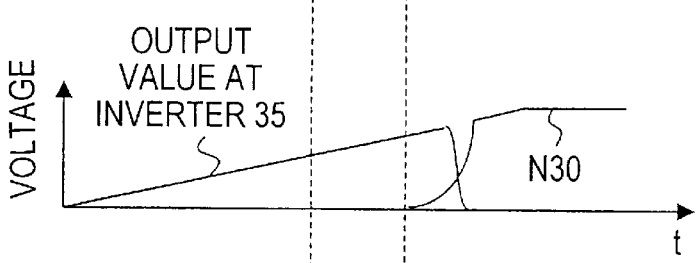
Figure 9D:
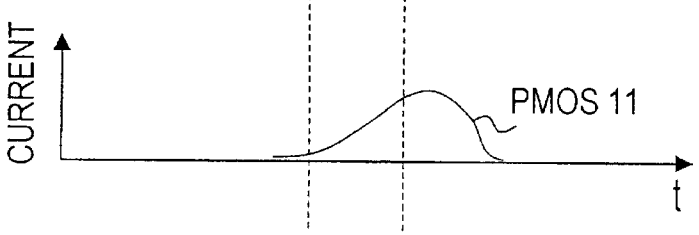
Figure 9E:
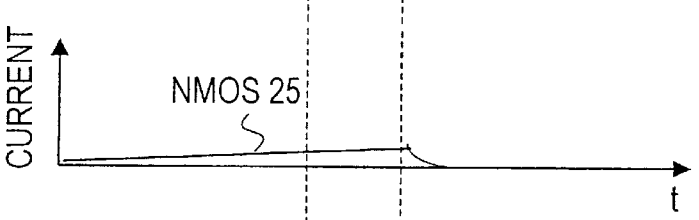
Figure 9F:
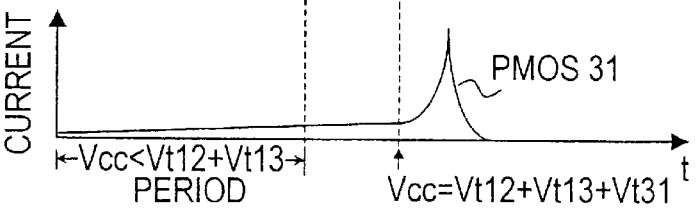
Figure 10A:
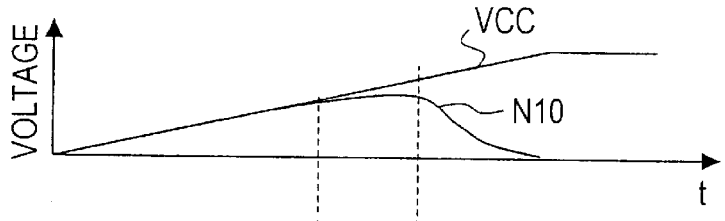
FIG. 10 is an explanatory diagram showing the waveform operation of the power-on reset circuit in FIG. 2.
Figure 10B:
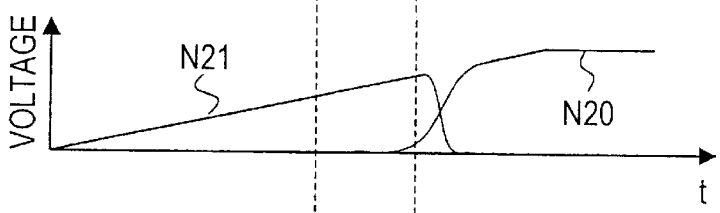
Figure 10C:
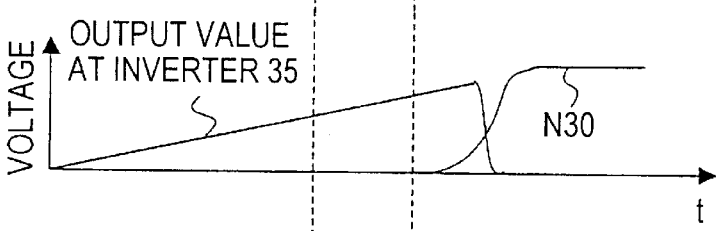
Figure 10D:
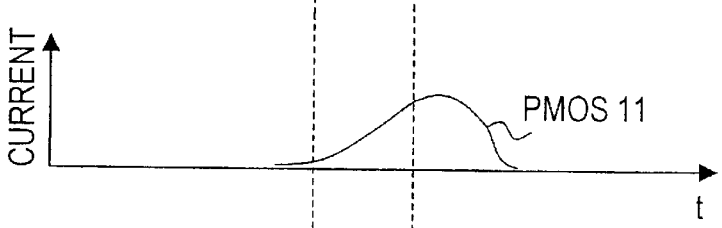
Figure 10E:
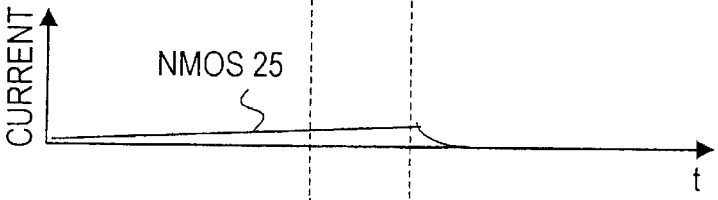
Figure 10F:
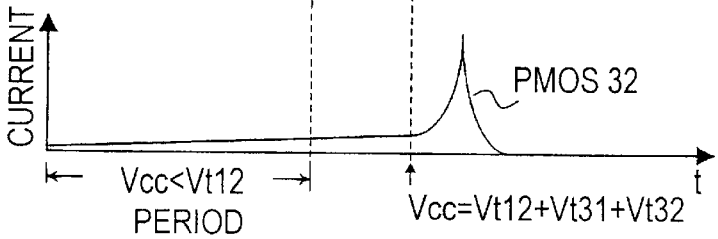
Figure 11A:
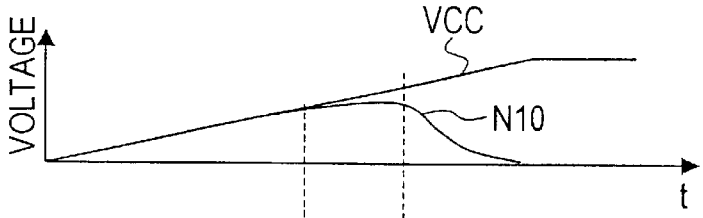
FIG. 11 is an explanatory diagram showing the waveform operation of the power-on reset circuit in FIG. 3.
Figure 11B:
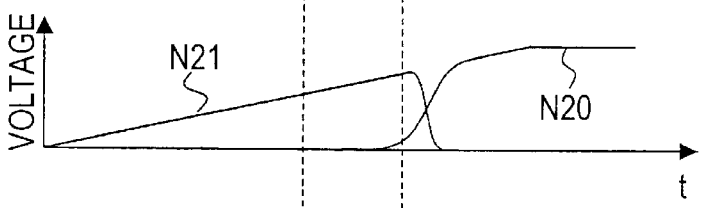
Figure 11C:
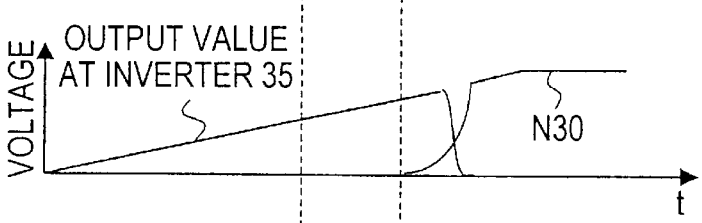
Figure 11D:
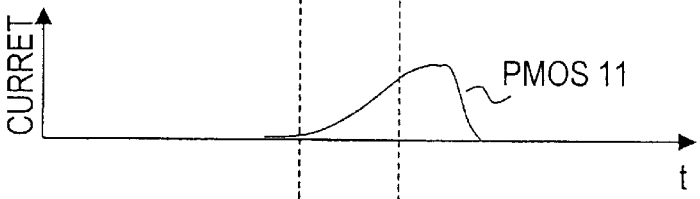
Figure 11E:
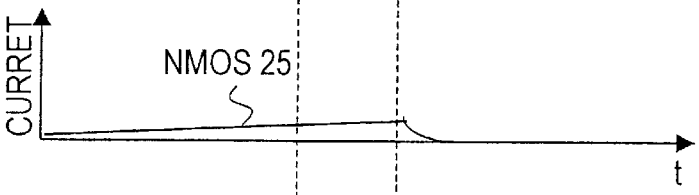
Figure 11F:
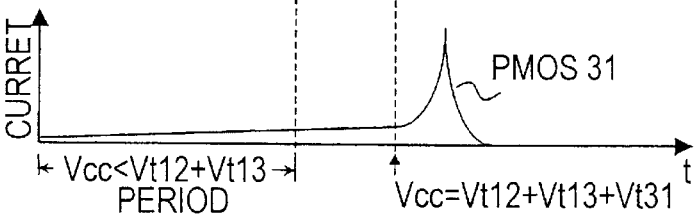
Figure 12A:
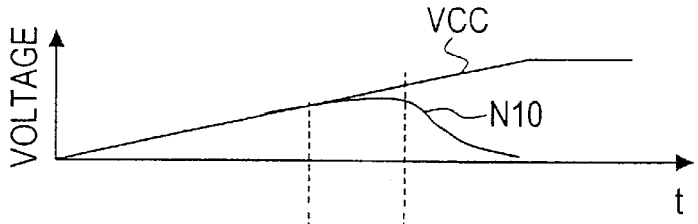
FIG. 12 is an explanatory diagram showing the waveform operation of the power-on reset circuit in FIG. 4.
Figure 12B:
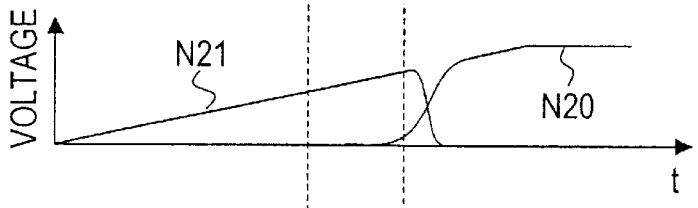
Figure 12C:
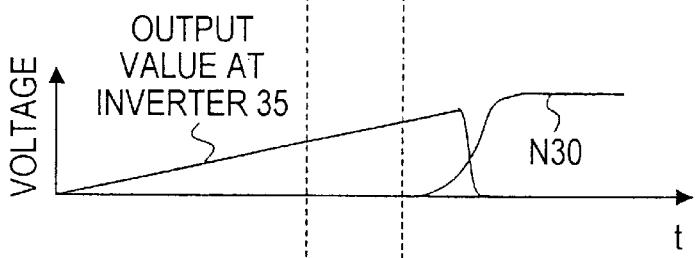
Figure 12D:
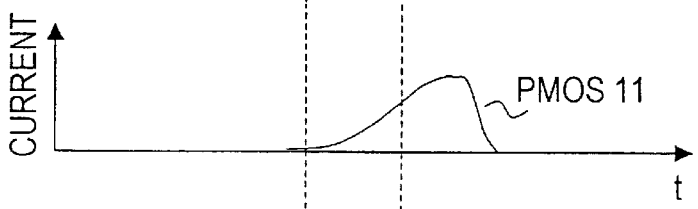
Figure 12E:
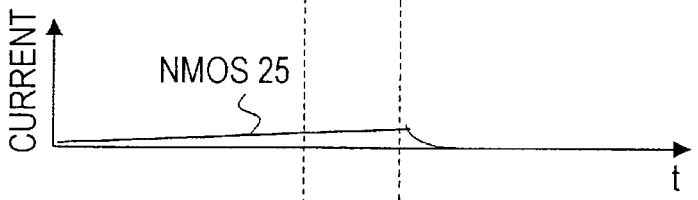
Figure 12F:
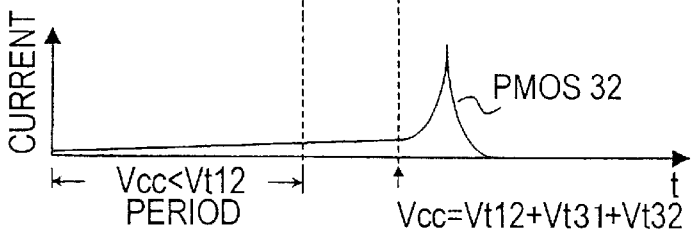
Figure 13A:
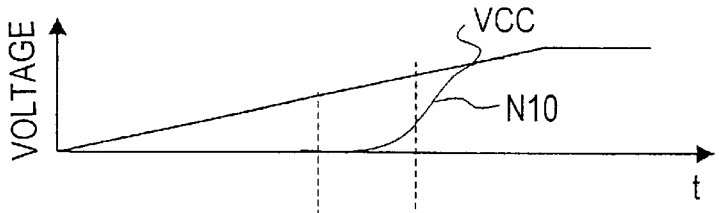
FIG. 13 is an explanatory diagram showing the waveform operation of the power-on reset circuit in FIG. 5.
Figure 13B:
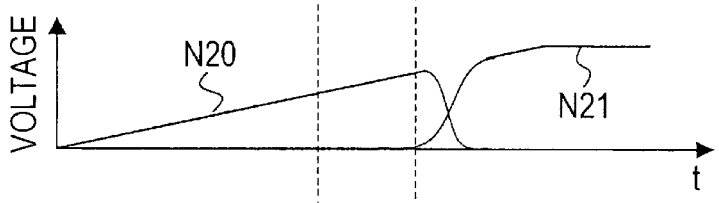
Figure 13C:
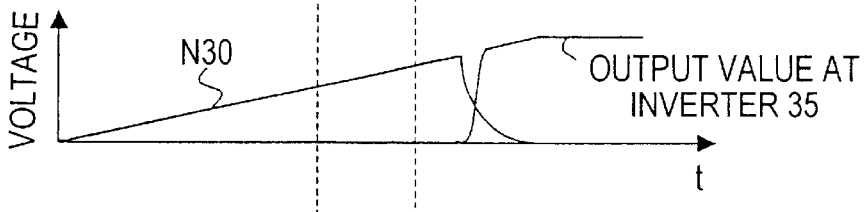
Figure 13D:
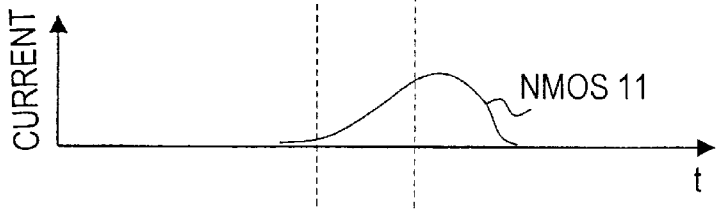
Figure 13E:
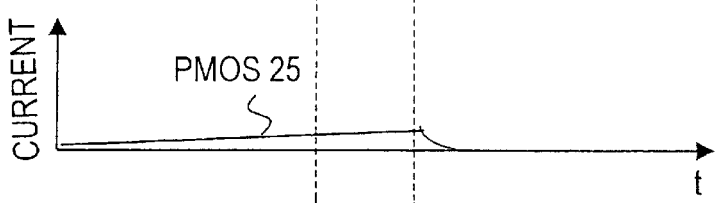
Figure 13F:
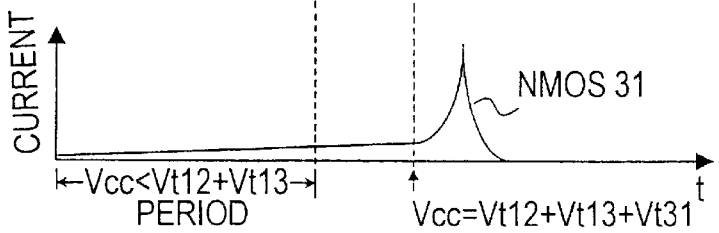
Figure 14A:
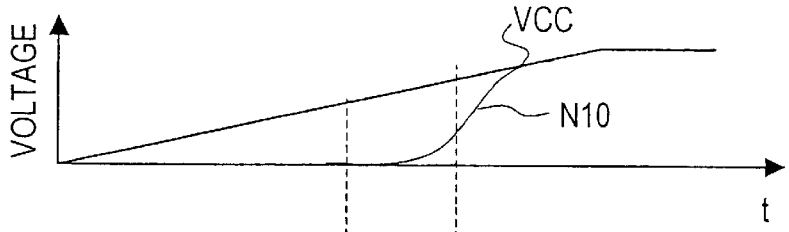
FIG. 14 is an explanatory diagram showing the waveform operation of the power-on reset circuit in FIG. 6.
Figure 14B:
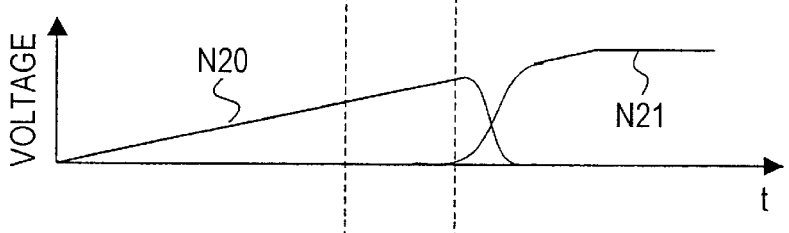
Figure 14C:
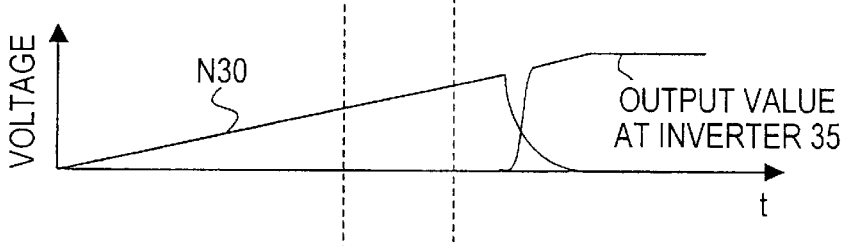
Figure 14D:
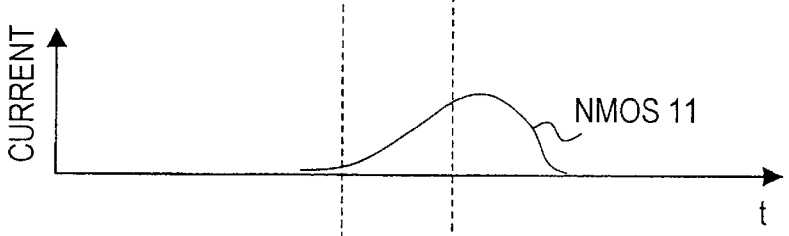
Figure 14E:
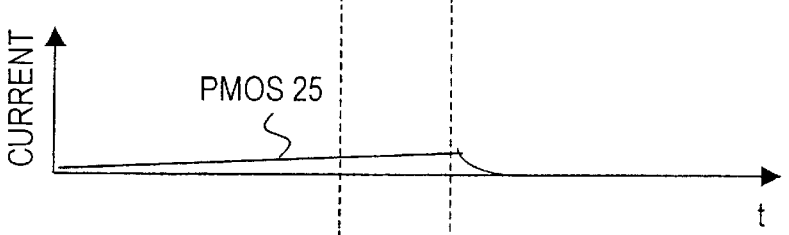
Figure 14F:
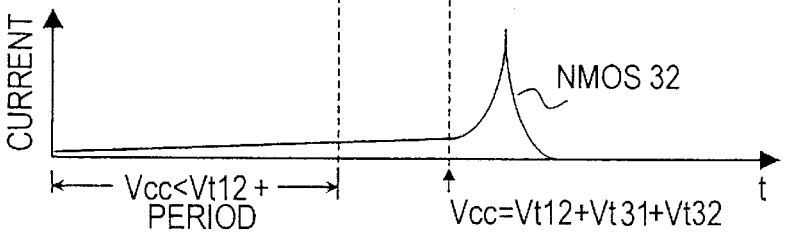
Figure 15A:
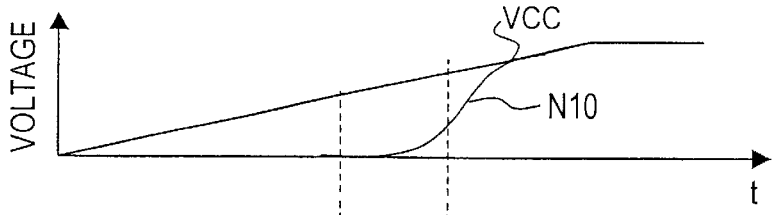
FIG. 15 is an explanatory diagram showing the waveform operation of the power-on reset circuit in FIG. 7.
Figure 15B:
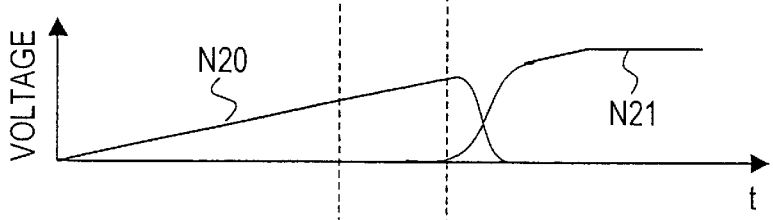
Figure 15C:
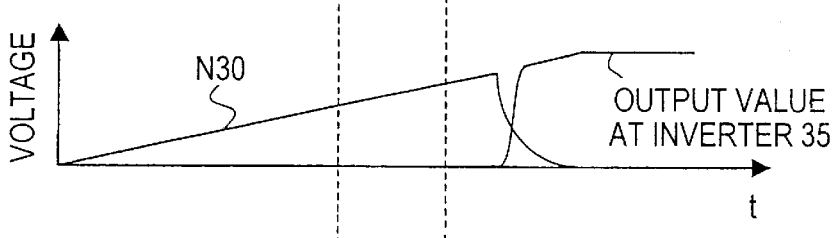
Figure 15D:
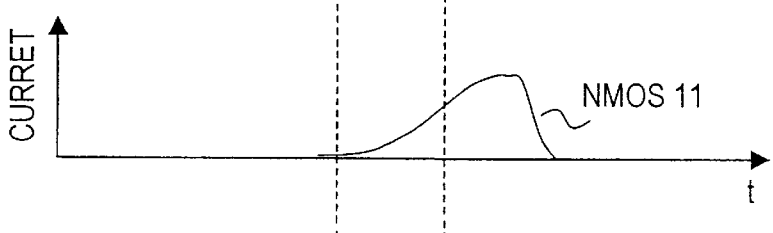
Figure 15E:
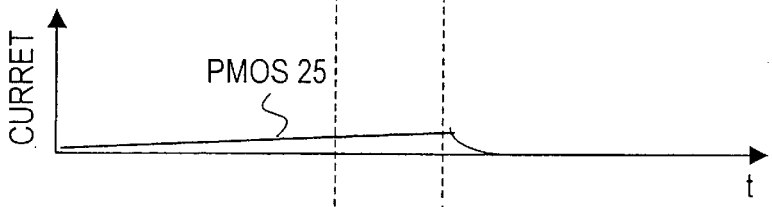
Figure 15F:
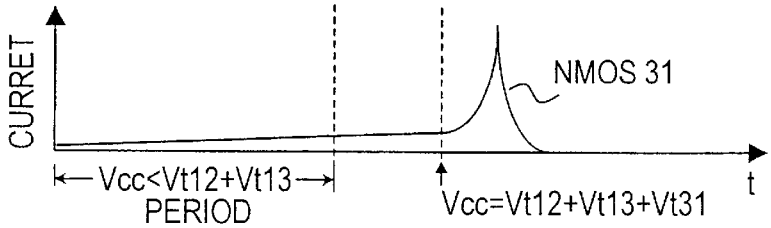
Figure 16A:
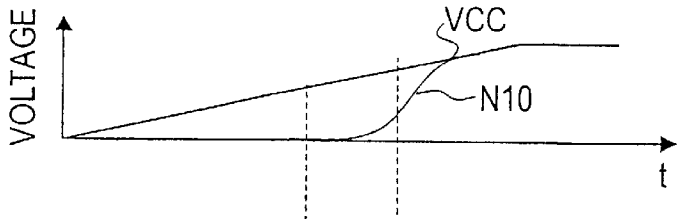
FIG. 16 is an explanatory diagram showing the waveform operation of the power-on reset circuit in FIG. 8.
Figure 16B:
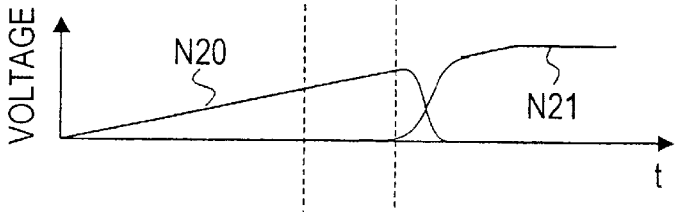
Figure 16C:
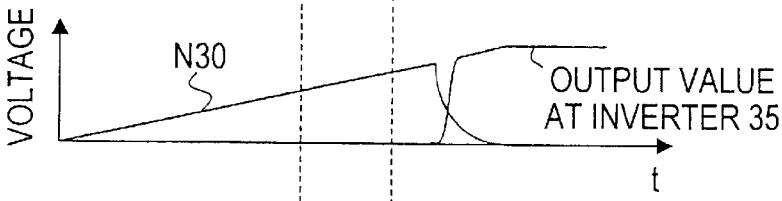
Figure 16D:
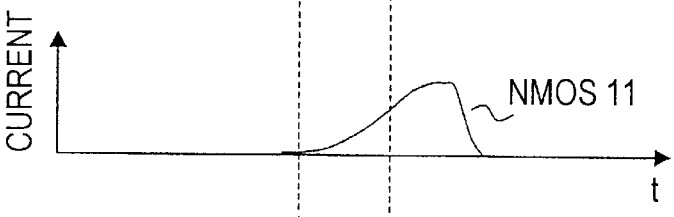
Figure 16E:
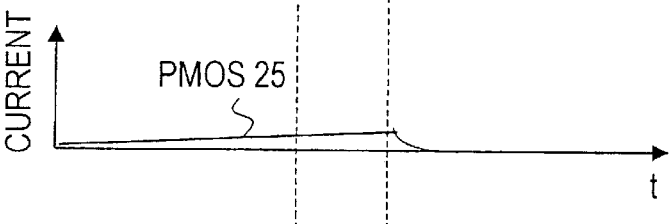
Figure 16F:
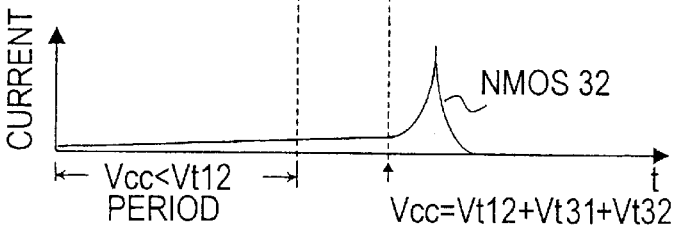

FIG. 8 is a circuit diagram of the power-on reset circuit in the eighth embodiment of the present invention. The power-on reset circuit has a power supply voltage sensing circuit 10 and a capacitor charge time constant circuit 30, which are different in the configuration from those of the seventh embodiment, an off-leakage current capacitor charge cutoff circuit 20, an output circuit 35 and an inverter 36 outputting an inversion signal of the output signal from the output circuit 35 to clamp the operation of the power supply voltage sensing circuit 10 after the output of the one-shot pulse from the output circuit.

The power supply voltage sensing circuit 10 has NMOS 11 the source of which is connected to the ground GND and which functions as an electric current path disconnecting means, NMOS 12 and NMOS 13 which form a rectifier and which are connected between the drain of the NMOS 11 and a power supply potential Vcc, and NMOS 14 to fix the output from the power supply voltage sensing circuit 10 at a power supply potential Vcc level "H" after the one-shot pulse is output between the drain of the PMOS 11 and the ground GND. The source of the NMOS 12 is connected to the drain of the PMOS 11 and the drain and gate of the NMOS 12 are connected to the power supply potential Vcc. A connection node N10 of the drain of the NMOS 11 and the source of the NMOS 12 is the output terminal of the power supply voltage sensing circuit 10.

The capacitor charge time constant circuit 30 has NMOS 31 the source of which is connected to the ground GND and forms rectifier, NMOS 32 the source of which is connected to the drain and gate of the NMOS 31, the gate of which is connected to the node N10, and which functions as an electric current flowing path means, and has NMOS 33 the gate of which is connected to the ground GND and which functions as a discharging means. The source of the NMOS 33 is connected to the drain of the NMOS 32 while the drain of the NMOS 33 is connected to the power supply potential Vcc. A charging MOS capacitance capacitor PMOS 34 is connected between the drain of the NMOS 32 and the power supply potential Vcc. The connection node N30 of the three points, that is, the drain of the NMOS 32, the source of the NMOS 33 and the gate of a MOS capacitance capacitor PMOS 34, is the output terminal of the capacitor charge time constant circuit 30, and is connected to the gate of the NMOS 11 and to the input terminal of the inverter 35.

The off-leakage current capacitor charge cutoff circuit 20 has PMOS 21 the gate of which is connected to a node N10 and the source of which is connected to the power supply potential, NMOS 22 the gate of which is connected to a node N10 and the source of which is connected to the ground GND, PMOS 23, the gate of which is connected to a connection node N20 of the drains of the PMOS 21 and NMOS 22 and the source of which is connected to the power supply potential Vcc, NMOS 24 the gate of which is connected to a node N20 and the source of which is connected to the ground GND, and PMOS 25, the gate of which is connected to a connection node N21 of the drains of the PMOS 23 and NMOS 24, the source of which is connected to the power supply potential Vcc, the drain of which is connected to the node N30 and which cuts off the charge of MOS capacitance capacitor PMOS 33 by the off-leakage current from the NMOS 31.

The inverter 35 is driven by the power supply potential Vcc as the power supply voltage sensing circuit 10, the off-leakage current capacitor charge cutoff circuit 20 and the capacitor charge time constant circuit 30, and an one-shot pulse is output from the output terminal of the inverter 35.

The inverter 36 is driven by the power supply potential Vcc as the power supply voltage sensing circuit 10, the off-leakage current capacitor charge cutoff circuit 20 and the capacitor charge time constant circuit 30, the output-inversion signal from the inverter 35 is input to the gates of the PMOS 11 and NMOS 14 in the power supply voltage sensing circuit 10.

FIGS. 16(*a*)–(*f*) is a waveform diagram showing the operation of the power-on reset circuit in FIG. 8. The operation thereof will be explained in reference to FIGS. 16(*a*)–(*f*).

When the power supply potential Vcc is 0V, the NMOS 33 becomes in the state of diode connection and the electric charge with which the gate of the MOS capacitance capacitor PMOS 34 is charged is discharged through the NMOS 33. Therefore, the voltage difference of the node N30 from the power supply potential Vcc becomes less than the threshold voltage Vt32 of the NMOS 33. In this state, even though the power supply voltage Vcc rises as in FIG. 16(*a*), the inverter 35 still outputs L level. The inverter 36 outputs L level rising with the rise of the power supply potential Vcc and inputs into the gates of the NMOS 11 and PMOS 14 in the power supply voltage sensing circuit 10. Consequently, the PMOS 14 is turned off.

When the power supply potential Vcc becomes more than the sum of the threshold voltage Vt33 and the threshold voltage Vt11 of the NMOS 11(Vt33+Vt11), the NMOS 33 is turned off, while the NMOS 11 becomes in the status which can be turned on. When the threshold voltage Vt12 of the NMOS 12 is set higher than the above sum (Vt33+Vt11), the voltage difference of the drain of the NMOS 11 from the power supply potential Vcc remains clamped by a MOS diode voltage Vt12 configured by the threshold voltage Vt12 of the NMOS 12 connected to the drain hereof in series. Therefore, the voltage of the node N10 becomes almost the same as the ground GND voltage while the gate potential of the NMOS 32 becomes almost equal to the ground GND voltage and the NMOS 32 remains turned off.

Even though an off-leakage current flows through the NMOS 32 with the gate potential almost equal to the power supply potential Vcc and with the NMOS 32 turned off, the voltage of the node N10 becomes almost the same as the ground GND voltage. As a result, an node N20 in the off-leakage current capacitor charge cutoff circuit 20 maintains H level rising with the rise of the power supply voltage Vcc, and an node N21 outputs ground GND L level, as shown in FIG. 16(*b*). Consequently, since the PMOS 25 cutting off the charge of MOS capacitance capacitor PMOS 34 by the off-leakage current from the NMOS 32 is turned on, all the off-leakage current from the NMOS 32 flow into the PMOS 25 as shown in FIG. 16(*e*), and the node N30 maintains the H level not inverting the L level in the inverter 35 and rising with the rise of the power supply voltage Vcc as shown in FIG. 16(*c*) without charging the gate voltage of the MOS capacitance capacitor PMOS 34 with the off-leakage current at the NMOS 32.

When the power supply voltage Vcc rises to become more than the sum voltage (Vt12+Vt31) of the threshold voltage Vt12 and the threshold voltage Vt31 of the NMOS 31, voltage (Vcc−(Vt12+Vt31)) is applied between the source and gate of the NMOS 32. Further when the power supply voltage Vcc rises to become more than the sum of the each threshold voltage Vt12 and Vt31, and the threshold voltage Vt32 of the PMOS 32 (Vt12+Vt31+Vt32), the NMOS 32 becomes completely turned on.

On the other hand, since the relative value to the power supply voltage Vcc of the node N10 voltage rises, the node N20 potential in the off-leakage current capacitor charge cutoff circuit 20 starts going down as the power supply voltage Vcc rises while the node N21 potential starts rising as the power supply voltage Vcc rises as shown in FIG. 16(*b*). As a result, the PMOS 25 starts being turned off, and the amount of current flowing into the PMOS 25 decreases as shown in FIG. 16(*e*), and finally, the PMOS 25 becomes completely turned off with the rise of the power supply voltage Vcc. When the NMOS 32 is turned on in this state, the current as shown in FIG. 16(*f*) flows through the NMOS 32 and the node N30 voltage goes down at the speed of the time constant decided by the gate capacity of the MOS capacitance capacitor PMOS 34. When the node 30 voltage reaches the threshold voltage at the inverter 35, the output value of the inverter 35 changes from L level to H level as shown in FIG. 16(*c*). Hereby the output of the one-shot pulse, which is started with the L level of the output value H from the inverter 35 is ended with the changed output value H from the inverter 35.

Since the output value of the inverter 36 changes to L level by changing that of the inverter 35 to H level, the NMOS 11 is turned off and the PMOS 14 is turned on. The node N10 voltage is clamped at H level with the PMOS 14 turned on. The NMOS 31 continues to be turned on and the node N30 level is maintained at L level with the node N10 voltage clamped at H level.

As described above, the power-on reset circuit in the eighth embodiment has the power supply voltage sensing means 10 having the NMOS 11 and 12 connected in series between the power supply potential Vcc and the ground GND; the capacitor charge time constant circuit 30; the inverter 35 and the inverter 36 outputting an inversion signal of the output signal from the output circuit 35 to clamp the operation of the power supply voltage sensing circuit 10 after the output of the one-shot pulse from the output circuit. In the power-on reset circuit, when the power supply potential Vcc becomes more than the voltage (Vt12+Vt31+Vt32), the gate of the MOS capacitance capacitor PMOS 34 in the capacitor charge time constant circuit 30 is started to be charged. As a result, even when the ramp-up speed of the power supply voltage Vcc is slow, the one-shot power-on reset pulse output by the inverter 35 starting from "L" right after the power application and ending with "H" can be accurately generated. Also, since the NMOS 11 finally becomes turned off after the pulse generation, wasteful current compensation can be eliminated after that. Further, since the charge into the gate of the MOS capacitance capacitor PMOS 34 by the NMOS 32 leakage-current in the NMOS 32 turned-off by setting the off-leakage current capacitor charge cutoff circuit 20 is. cut off, the problem that the one-shot pulse cannot be output, caused by using a minute MOS element in which the off-leakage current through the MOS (under high temperature) tends to increase.

Further, the power-on reset circuit in the eighth embodiment is effective, as in the sixth embodiment, to generate a longer-time one shot pulse than those in the fifth and seventh embodiments. In other words, since NMOS 31 is set between the NMOS 32 and the ground GND, as the gate of the MOS capacitance capacitor PMOS 34 is progressively charged and the voltage at the node N30 goes down, the operation region of the NMOS 32 changes from a saturation region to a non-saturation region to reduce the amount of current flowing the drain and source of the PMOS 32. More specifically, the speed at which the gate of the MOS capacitance capacitor PMOS 34 is charged is lowered. Therefore, if the threshold voltage at the inverter 35 is set higher than the voltage at which the NMOS 32 operates in the non-saturation region, the longer-time one-shot pulse can be generated without enlarging the gate area of the MOS capacitance capacitor NMOS to increase the capacitance value.

Further, the power-on reset circuit in the eighth embodiment is effective, as in the seventh embodiment, when a wasteful current consumption is desired to be eliminated after the one-shot pulse output in the case of more considerable GND noise than in the sixth embodiment. In other words, in the case of the considerable GND noise in the fifth embodiment, the noise is directly input to the source of the PMOS 11 in the power supply voltage sensing circuit 10 while a primary lag GND noise through a primary low pass filter configured by the NMOS 31 and 32 and MOS capacitance capacitor PMOS 33 in the capacitor charge time constant circuit 30 is input to the gate of the NMOS 11. For this reason, since the GND noise and the primary lag GND noise cannot keep in phase each other and have a phase contrast, the fear arises that a wasteful current consumption is generated by flowing a current through the NMOS 11 in the case of a high-frequency GND noise. However in the power-on reset circuit in the eighth embodiment, since the power supply voltage at the gate of the NMOS 11 in the power supply voltage sensing means 10 after the one-shot pulse output is L level output from the inverter 36, the GND noises input to the drain and gate of the NMOS 11 can keep in phase. Therefore, the wasteful current consumption can be deleted even in the considerable GND noise.

Although the preferred embodiment of the present invention has been described referring to the accompanying drawings, the present invention is not restricted to such examples. It is evident to those skilled in the art that the present invention may be modified or changed within a technical philosophy thereof and it is understood that naturally these belong to the technical philosophy of the present invention.

First Modification

Figure 17:
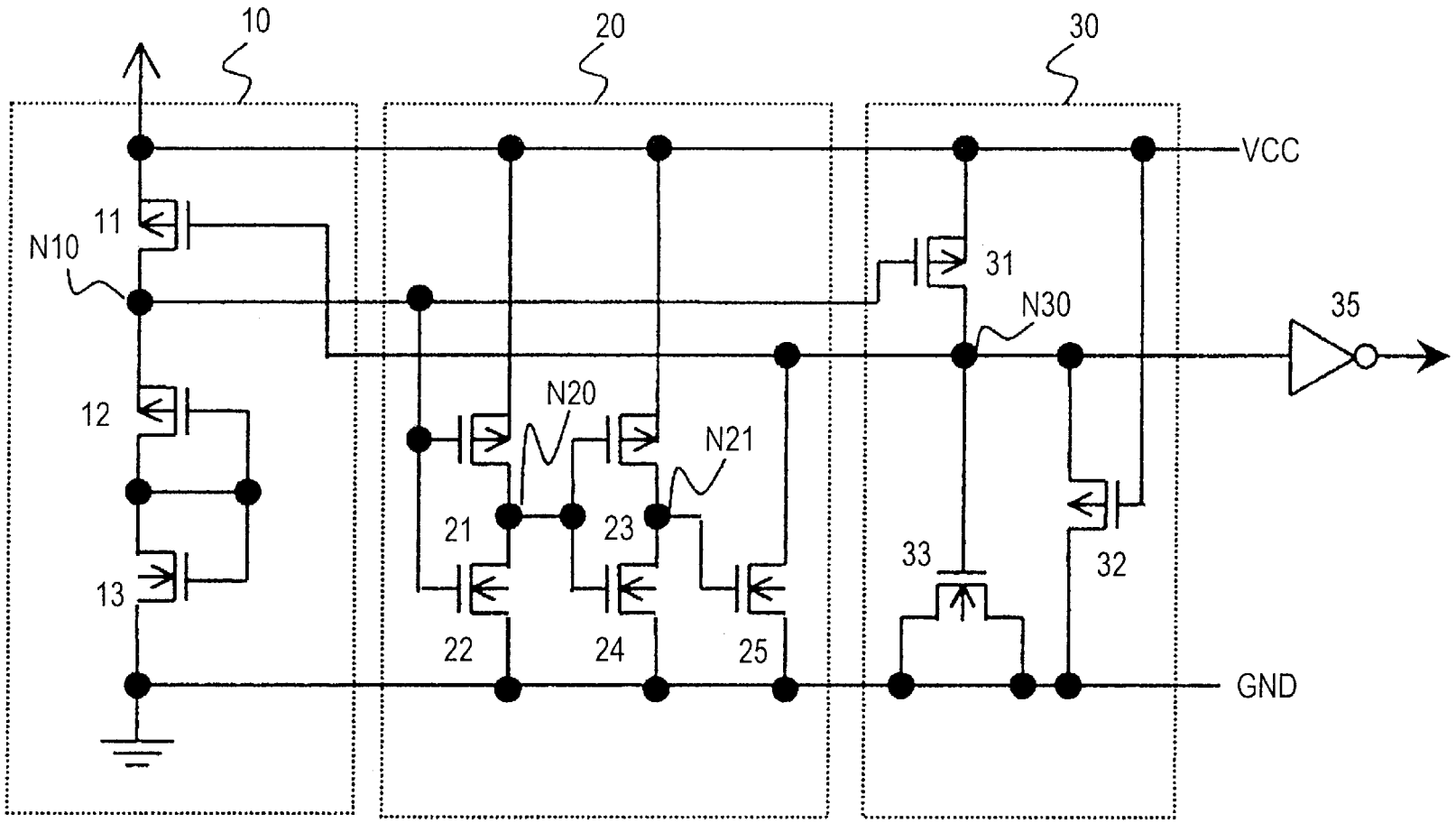
FIG. 17 is an explanatory diagram showing the first modification of the first embodiment.

FIG. 17 shows the circuit diagram of the first modification in the first embodiment. In this embodiment, the rectifier functioning as a power supply voltage sensing means in the power supply voltage sensing circuit 10 is configured by only PMOS diode, the rectifier is configured by PMOS diode and NMOS diode in this modification.

Second Modification

Figure 18:
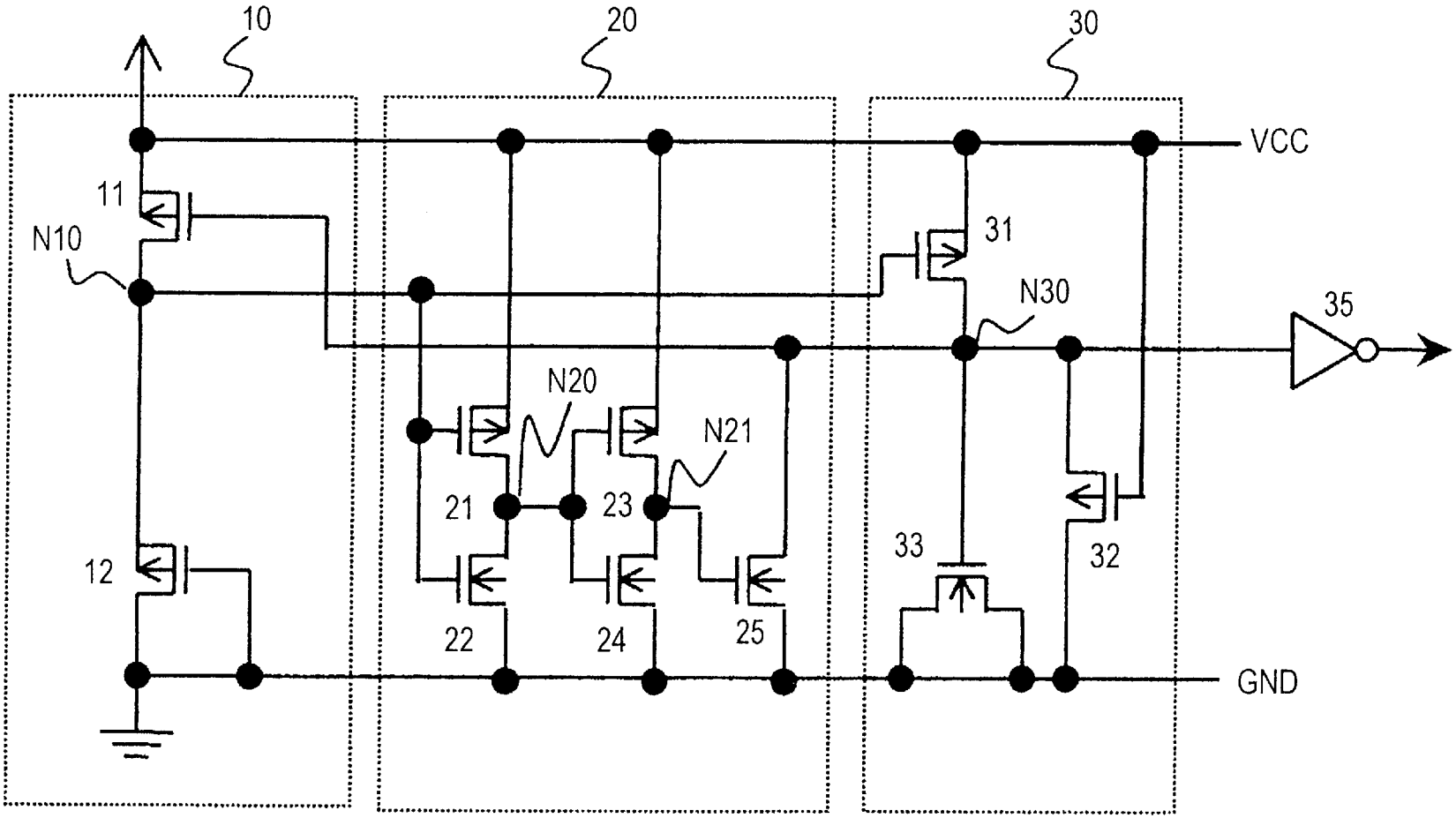
FIG. 18 is an explanatory diagram showing the second modification of the first embodiment.

FIG. 18 shows the circuit diagram of the second modification in the first embodiment. In this embodiment, although the rectifier functioning as a power supply voltage sensing means in the power supply voltage sensing circuit 10 is configured by two steps of PMOS diode, the rectifier is configured by a step of PMOS diode in this modification.

Third Modification

Figure 19:
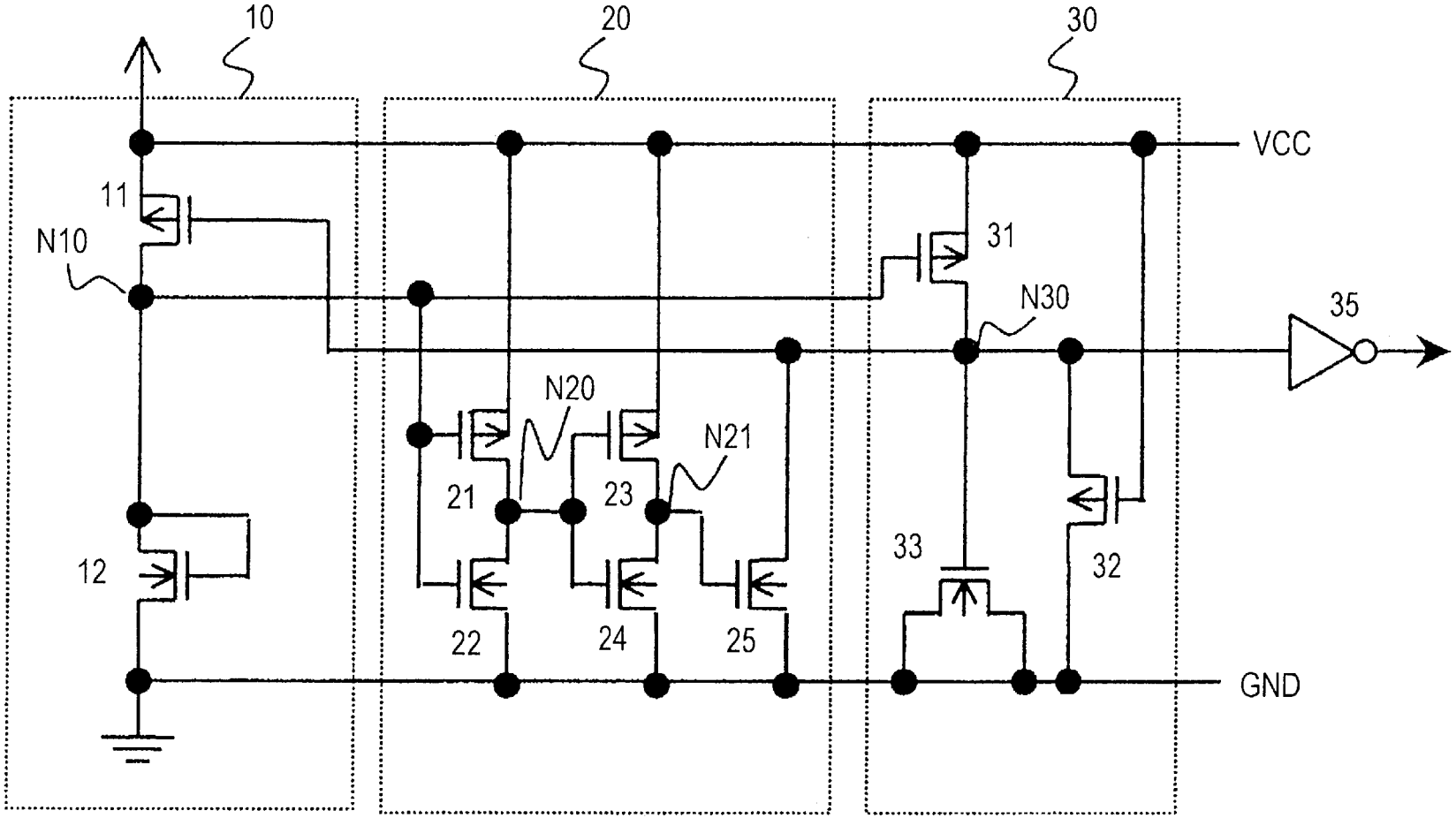
FIG. 19 is an explanatory diagram showing the third modification of the first embodiment.

FIG. 19 shows the circuit diagram of the third modification in the first embodiment. In this embodiment, although the rectifier functioning as a power supply voltage sensing means in the power supply voltage sensing circuit 10 is configured by two steps of PMOS diode, the rectifier is configured by a step of NMOS diode in this modification.

Fourth Modification

Figure 20:
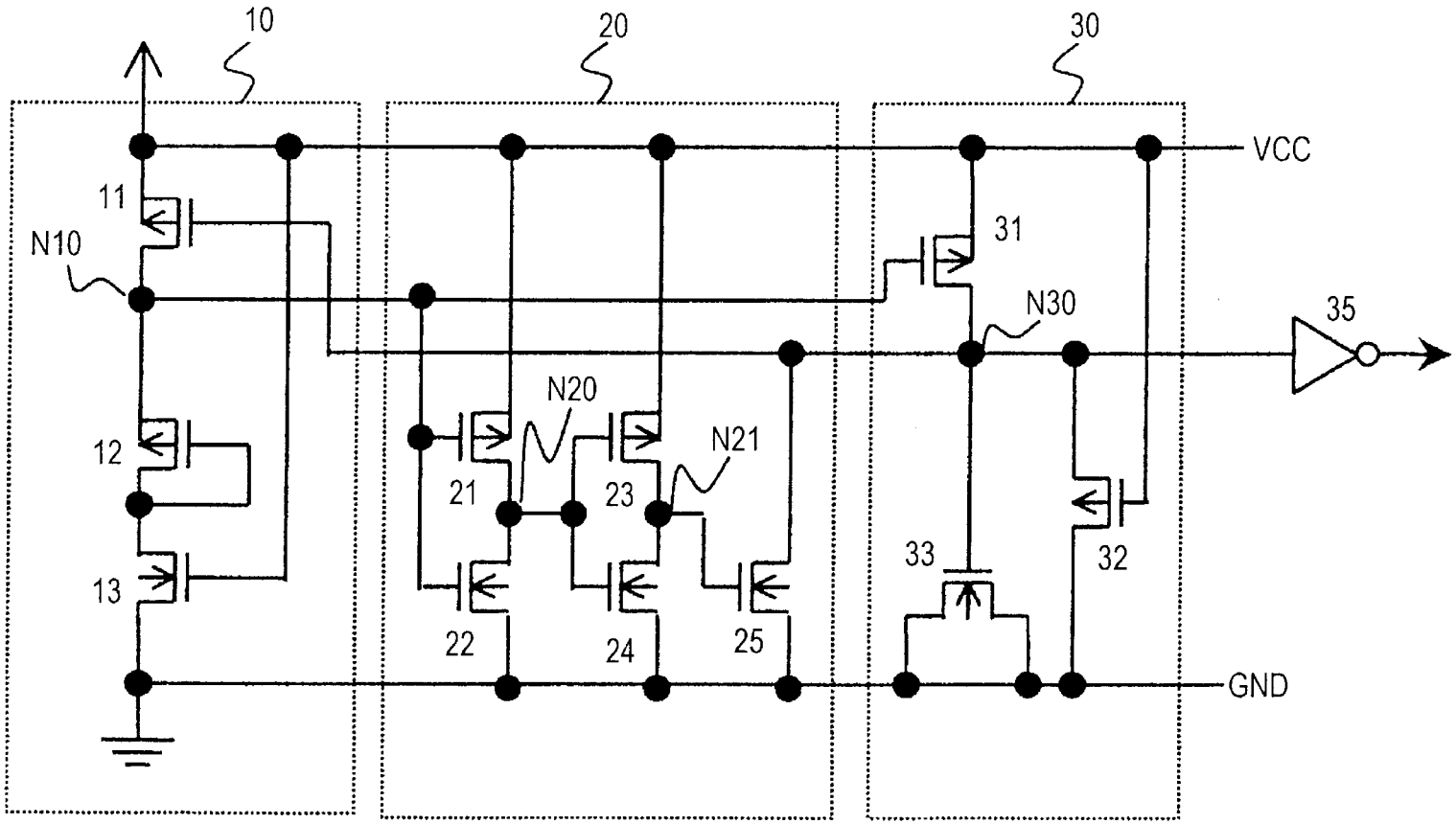
FIG. 20 is an explanatory diagram showing the fourth modification of the first embodiment.

FIG. 20 shows the circuit diagram of the fourth modification in the first embodiment. In this embodiment, although the rectifier functioning as a power supply voltage sensing means in the power supply voltage sensing circuit 10 is configured by two steps of PMOS diode, the rectifier is configured by a step of PMOS diode and NMOS saturation Vds voltage in this modification.

Fifth Modification

Figure 21:
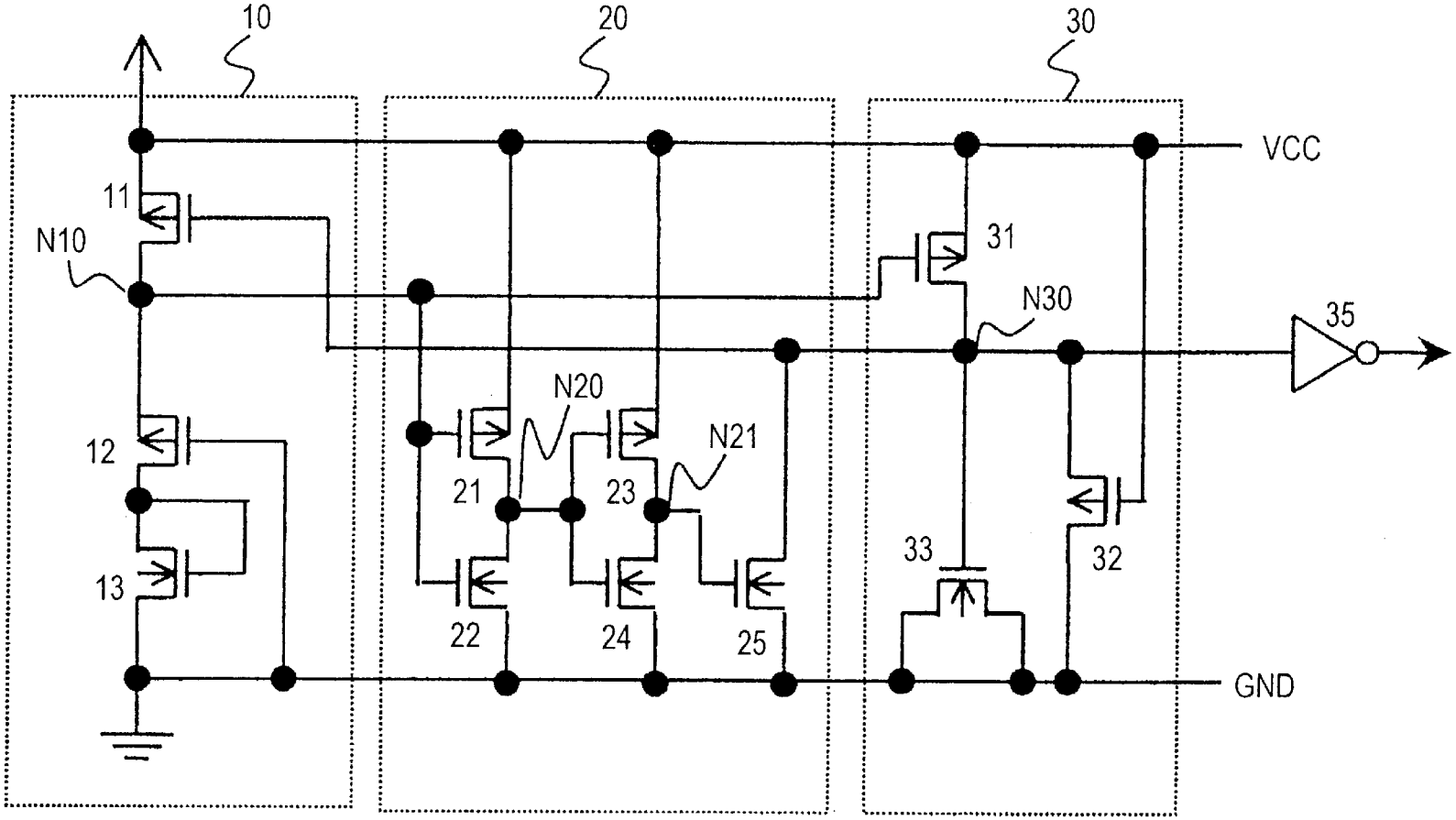
FIG. 21 is an explanatory diagram showing the fifth modification of the first embodiment.

FIG. 21 shows the circuit diagram of the fifth modification in the first embodiment. In this embodiment, although the rectifier functioning as a power supply voltage sensing means in the power supply voltage sensing circuit 10 is configured by two steps of PMOS diode, the rectifier is configured by a step of NMOS diode and PMOS saturation Vds voltage in this modification.

Sixth Modification

Figure 22:
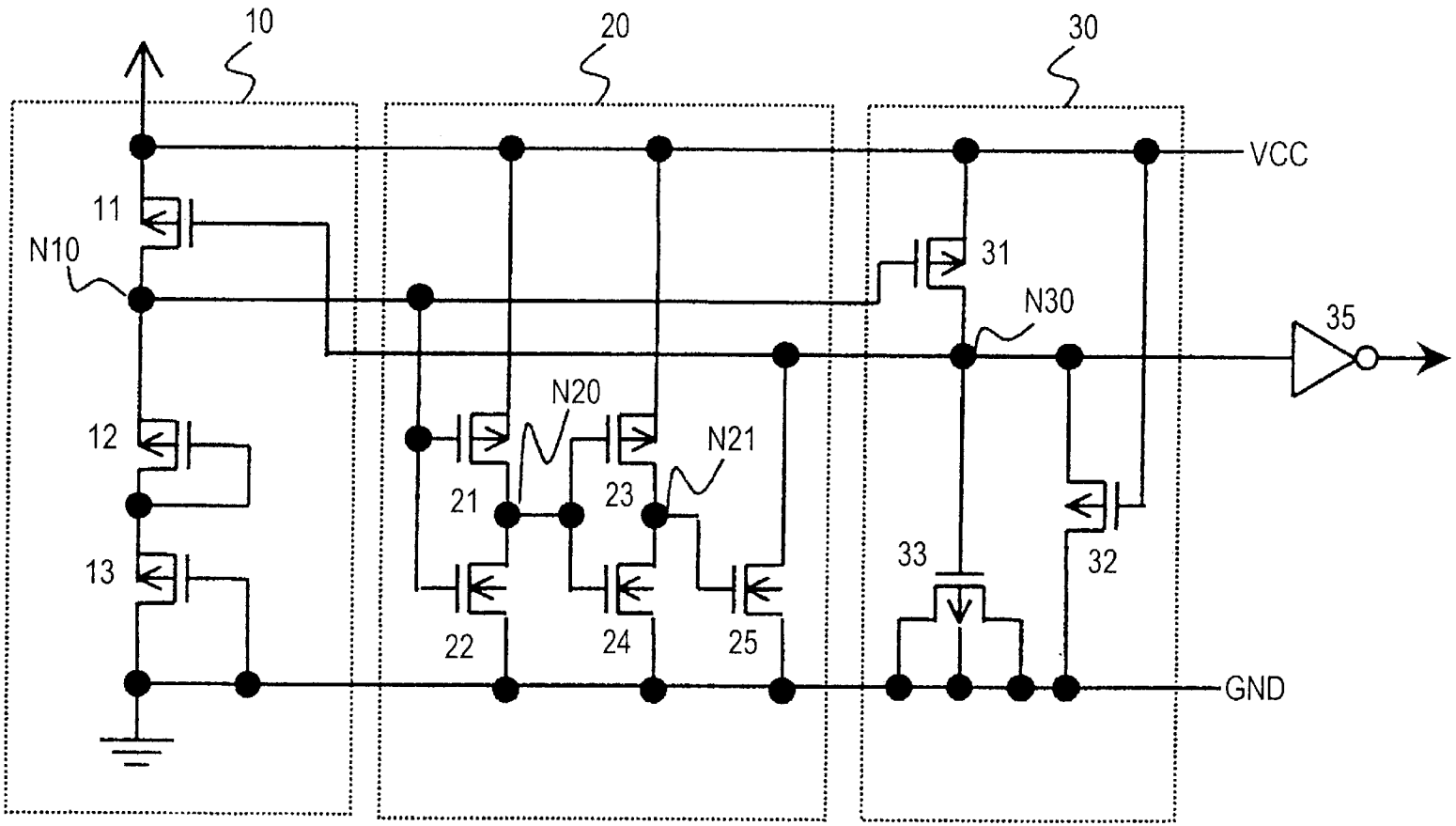
FIG. 22 is an explanatory diagram showing the sixth modification of the first embodiment.

FIG. 22 shows the circuit diagram of the sixth modification in the first embodiment. In this embodiment, although the capacitance element in the capacitor charge time constant circuit 30 is configured by NMOS gate capacitance, the capacitance element is configured by PMOS gate capacitance in this modification.

Seventh Modification

Figure 23:
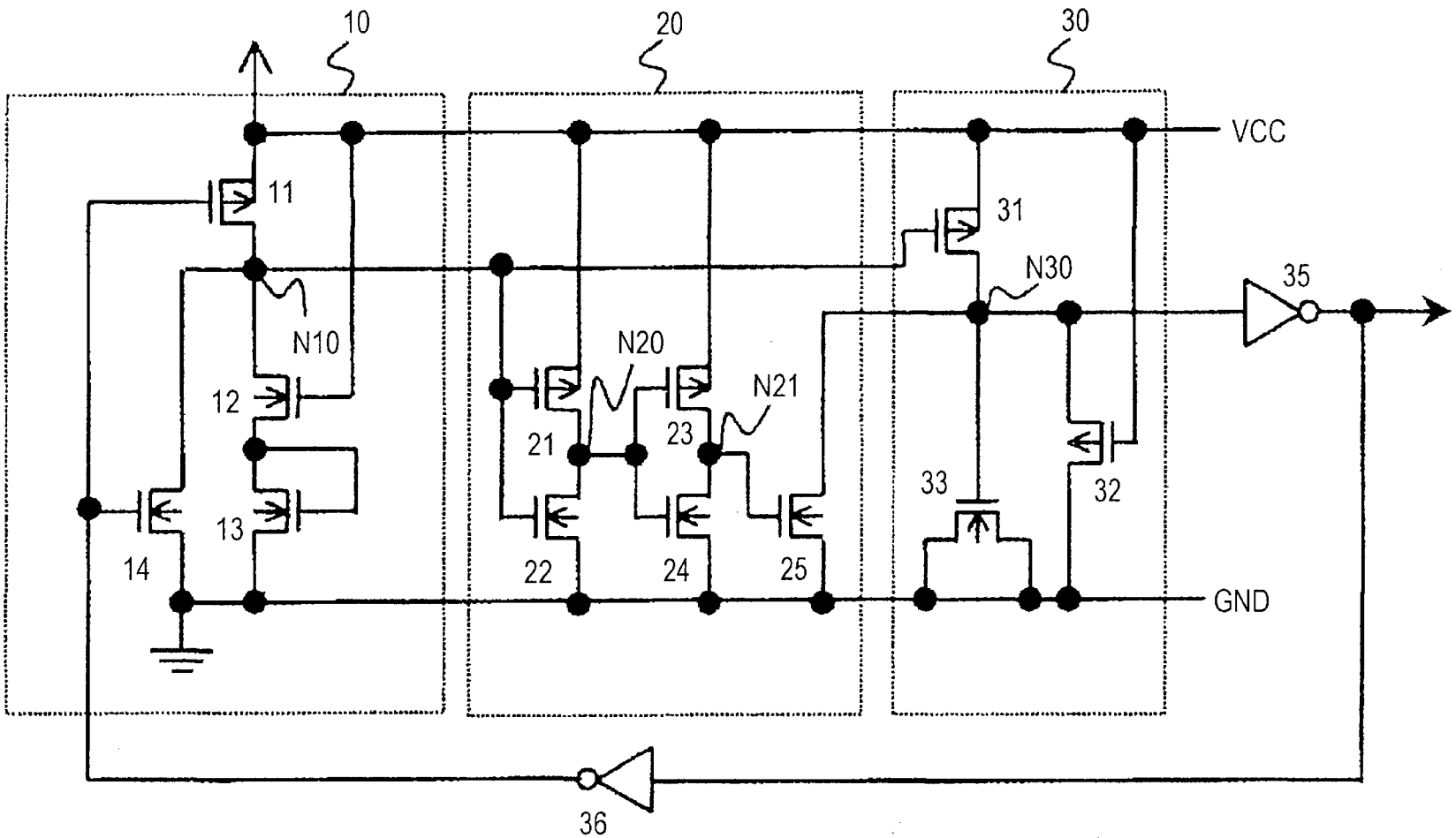
FIG. 23 is an explanatory diagram showing the modification of the third embodiment.
Figure 24:
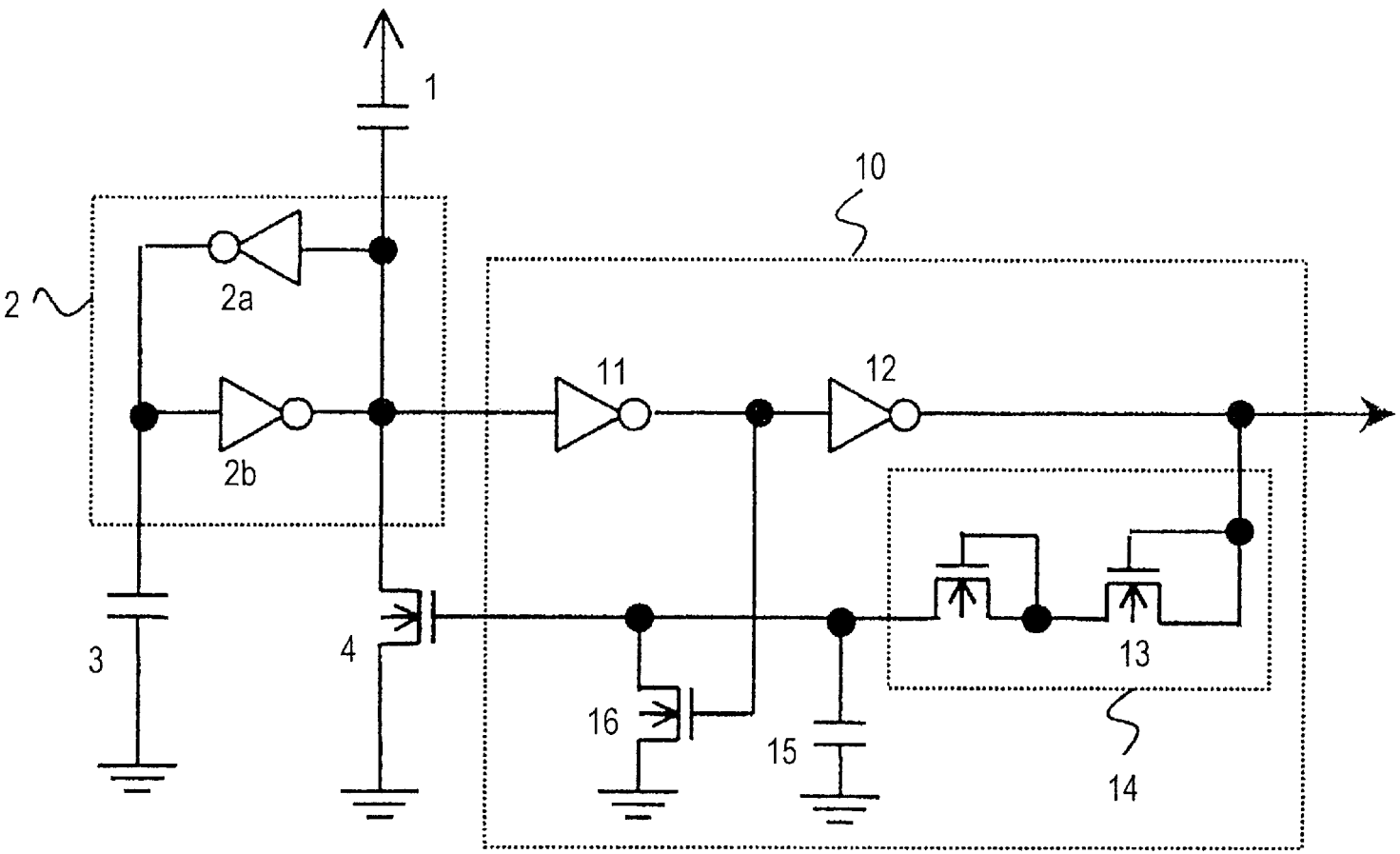
FIG. 24 is an explanatory diagram showing the conventional first power-on reset circuit.
Figure 25:
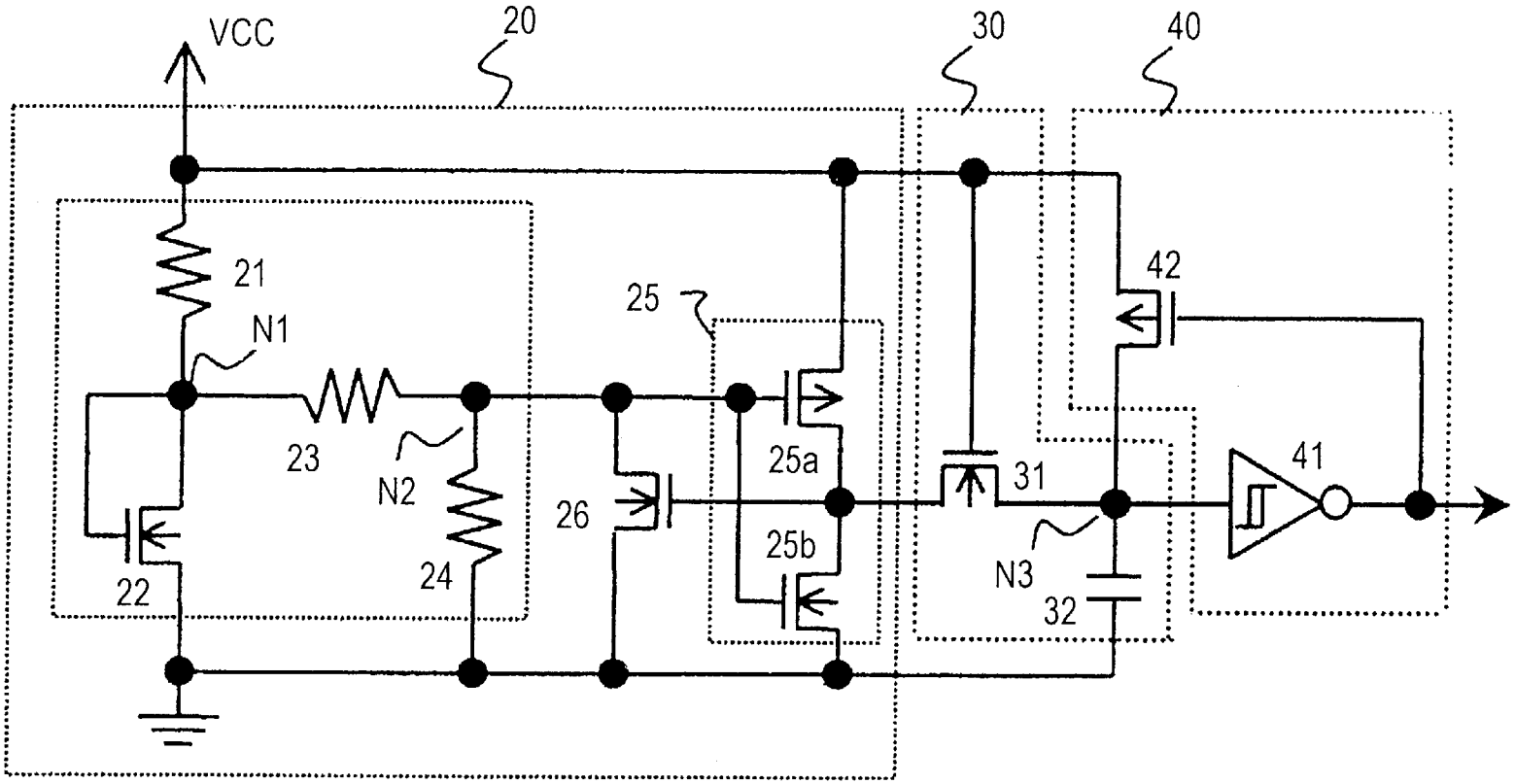
FIG. 25 is an explanatory diagram showing the conventional second power-on reset circuit.
Figure 26:
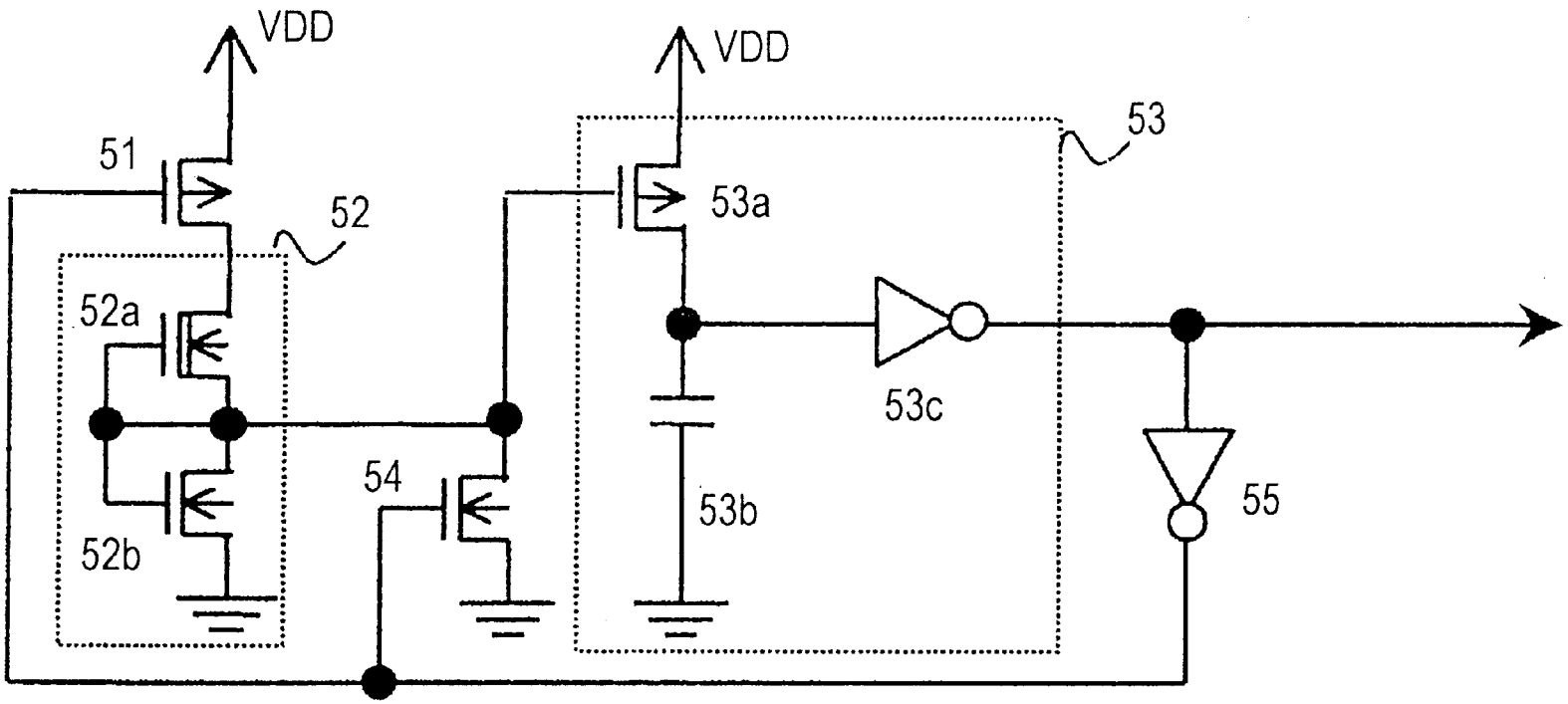
FIG. 26 is an explanatory diagram showing the conventional third power-on reset circuit.
Figure 27:
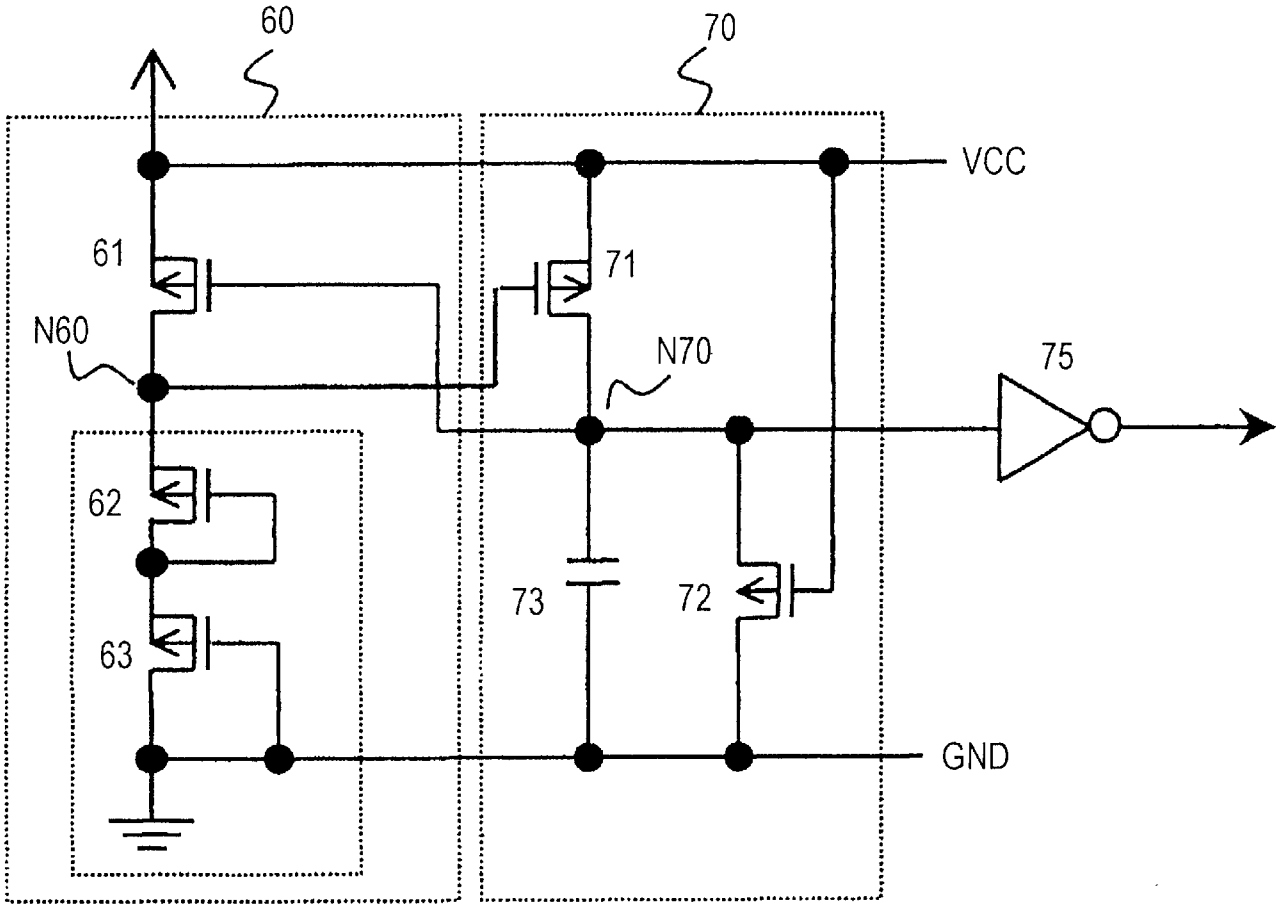
FIG. 27 is an explanatory diagram showing the conventional fourth power-on reset circuit.

FIG. 23 shows the circuit diagram of the modification in the third embodiment. In this embodiment, although the rectifier functioning as a power supply voltage sensing means in the power supply voltage sensing circuit 10 is configured by two steps of PMOS diode, the rectifier is configured by a step of NMOS diode and NMOS saturation Vds voltage in this modification.

The above modifications are not restricted to the ones in the first and the third embodiments, and can be adopted to all the embodiments in the present invention. Also, it is possible to combine the above modifications each other, for example, the first one with the sixth one. These combinations enable to set the power supply potential Vcc generating the one-shot power-on reset pulse at a particular threshold voltage according to the object and the application process characteristic, and to select and use a more favorable capacitance element on the application process.

As described above, the main effect of the present invention enables to generate the one-shot power-on reset pulse in which the output of the output inverter starts with "H" right after the power application and ends with "L" even when the electric current flowing path means in the capacitor charge time constant circuit is configured by using a minute MOS element in which the off-leakage current through the MOS (under high temperature) tends to increase and even when the ramp-up speed of the power supply voltage Vcc is slow, and enables to eliminate a wasteful current consumption after the power-on reset pulse generation by operating electric current path disconnecting means in the power supply voltage sensing circuit.

Further, the main effect can be made solid by adopting the embodiments and the modifications as described above.

What is claimed is:

1. A power-on reset circuit comprising:

a first node to which a power supply voltage is supplied;

a second node to which a reference voltage is supplied;

a voltage supply circuit which has a first switch electrically connecting the first node with a fourth node in response to a voltage level of a third node, and a diode being connected to the second node and to the fourth node;

a time constant circuit which has a second switch electrically connecting the first node with the third node in response to the voltage level of the fourth node, and a capacitor being connected to the second node and to the third node; and a third switch which electrically connects the second node with the third node in response to the voltage level of the fourth node.

2. A power-on reset circuit comprising: a power supply voltage sensing circuit comprising a voltage sensing means connected between a first power supply potential and a second power potential which show the power supply voltage by the potential difference to flow and form the electric current path when the power supply voltage reaches more than a specific threshold value and showing the sensed voltage on a first node, and an electric current path disconnecting means achieving on-off control based on the feedback voltage to disconnect the electric current path in the off-state, and sensing the power supply voltage application with the electric current path disconnecting means on-state;

a capacitance element charge time constant circuit comprising an electric current flowing path means connected between the first power supply potential and the second node and flowing path based on the sensed voltage, a capacitance element connected between the second node and the second power supply potential to charge based on the time constant through the electric current flowing path means, and a discharging means flowing path when the power supply voltage is less than the specific threshold voltage to discharge the capacitance element;

an off-leakage current capacitance element charge cutoff circuit comprising a charge cutoff means cutting off the charge to the capacitance element by the off-leakage current from the electric current flowing path means in the capacitance element charge time constant circuit; and an output circuit, the driving source of which is the power source voltage, judging the second-node voltage by a specific threshold value and outputting a one-shot pulse with logical-level in response to the judging result;

the power-on reset circuit wherein: the second node voltage is applied to the charge cutoff means in the power supply voltage sensing circuit as the feedback voltage;

the charge to the capacitance element by the off-leakage current from the electric current flowing path means in the capacitance element charge time constant circuit is cut off by the charge cutoff means in the off-leakage current capacitance element charge cutoff circuit when the power supply voltage is less than the specific threshold voltage; and the charge to the capacitance element in the capacitance element charge time constant circuit starts when the power supply voltage becomes more than the specific threshold voltage.

3. A power-on reset circuit according to claim 2 wherein the electric current path disconnecting means, the electric current flowing path means and the discharging means are respectively configured by a first conductive-type transistor and wherein the charge cutoff means is configured by a second conductive-type transistor.

4. A power-on reset circuit according to claim 2 wherein the capacitance element charge time constant circuit comprises a rectifier inserted between the electric current flowing path means and the first power supply potential.

5. A power-on reset circuit according to claim 4 wherein the electric current path disconnecting means, the electric current flowing path means and the discharging means are respectively configured by a first conductive-type transistor and wherein the charge cutoff means is configured by a second conductive-type transistor.

6. A power-on reset circuit according to claim 2 wherein an inverter element outputting a one-shot pulse inversion signal to clamp the operation of the power supply voltage sensing circuit after the output of the one-shot pulse from the output circuit is provided.

7. A power-on reset circuit according to claim 6 wherein the electric current path disconnecting means, the electric current flowing path means and the discharging means are respectively configured by a first conductive-type transistor and wherein the charge cutoff means is configured by a second conductive-type transistor.

8. A power-on reset circuit comprising: a power supply voltage sensing circuit comprising a voltage sensing means connected between a first power supply potential and a second power potential which show the power supply voltage by the potential difference to flow and form the electric current path when the power supply voltage reaches more than a specific threshold value and showing the sensed voltage on a first node, and an electric current path disconnecting means achieving on-off control based on the feedback voltage to disconnect the electric current path in the off-state, and sensing the power supply voltage application with the electric current path disconnecting means on-state;

a capacitance element charge time constant circuit comprising an electric current flowing path means connected between the first power supply potential and the second node and flowing path based on the sensed voltage, a rectifier inserted between the electric current flowing path means and the first power supply potential, a capacitance element connected between the second node and the second power supply potential to charge based on the time constant through the electric current flowing path means, and a discharging means flowing path when the power supply voltage is less than the specific threshold voltage to discharge the capacitance element;

an off-leakage current capacitance element charge cutoff circuit comprising a charge cutoff means cutting off the charge to the capacitance element by the off-leakage current from the electric current flowing path means in the capacitance element charge time constant circuit;

an output circuit, the driving source of which is the power source voltage, judging the second-node voltage by a specific threshold value and outputting an one-shot pulse with logical-level in response to the judging result; and an inverter element outputting an one-shot pulse inversion signal to clamp the operation of the power supply voltage sensing circuit after the output of the one-shot pulse from the output circuit;

the power-on reset circuit wherein: the second node voltage is applied to the charge cutoff means in the power supply voltage sensing circuit as the feedback voltage;

the charge to the capacitance element by the off-leakage current from the electric current flowing path means in the capacitance element charge time constant circuit is cut off by the charge cutoff means in the off-leakage current capacitance element charge cutoff circuit when the power supply voltage is less than the specific threshold voltage; and the charge to the capacitance element in the capacitance element charge time constant circuit starts when the power supply voltage becomes more than the specific threshold voltage.

9. A power-on reset circuit according to claim 8 wherein the electric current path disconnecting means, the electric current flowing path means and the discharging means are respectively configured by a first conductive-type transistor and wherein the charge cutoff means is configured by a second conductive-type transistor.

10. A power-on reset circuit according to claim 2 wherein the voltage sensing means is configured by a P-channel type MOS diode and an N-channel type MOS diode.

11. A power-on reset circuit according to claim 2 wherein the voltage sensing means is configured by a step of P-channel type MOS diode.

12. A power-on reset circuit according to claim 2 wherein the voltage sensing means is configured by a step of N-channel type MOS diode.

13. A power-on reset circuit according to claim 2 wherein the voltage sensing means is configured by a step of P-channel type MOS diode and NMOS saturation Vds voltage.

14. A power-on reset circuit according to claim 2 wherein the voltage sensing means is configured by a step of N-channel type MOS diode and PMOS saturation Vds voltage.

15. A power-on reset circuit according to claim 2 wherein the capacitance element in the capacitance element charge time constant circuit is configured by P-channel MOS gate capacitance.

16. A power-on reset circuit according to claim 6 wherein the voltage sensing means is configured by a step of N-channel type MOS diode and NMOS saturation Vds voltage.

* * * * *